US009604771B1

(12) United States Patent
Chen

(10) Patent No.: US 9,604,771 B1
(45) Date of Patent: Mar. 28, 2017

(54) TOOL HOLDER

(71) Applicant: Chao-Ming Chen, Taichung (TW)

(72) Inventor: Chao-Ming Chen, Taichung (TW)

( * ) Notice: Subject to any disclaimer, the term of this patent is extended or adjusted under 35 U.S.C. 154(b) by 0 days.

(21) Appl. No.: 15/065,929

(22) Filed: Mar. 10, 2016

(51) Int. Cl.
*B25H 3/00* (2006.01)
*B65D 79/02* (2006.01)
*B65D 73/00* (2006.01)

(52) U.S. Cl.
CPC ..... *B65D 79/02* (2013.01); *B25H 3/003* (2013.01); *B65D 73/0064* (2013.01)

(58) Field of Classification Search
CPC B65D 79/02; B65D 73/0064; B65D 73/0007; B65D 5/4208; B25H 3/003
USPC ..... 206/349, 806, 378, 377, 376, 1.5, 495, 206/493
See application file for complete search history.

(56) References Cited

U.S. PATENT DOCUMENTS 5,988,381 A * 11/1999 Ling ..... B65D 73/0064 206/349
7,624,865 B2 * 12/2009 Pendergraph ..... B65D 73/0064 206/349
8,251,343 B2 * 8/2012 Zhang ..... A47F 5/0006 206/349
8,261,912 B1 * 9/2012 Ingrey-Senn ..... A47F 5/0006 206/349
8,864,097 B2 * 10/2014 Wang ..... F16M 13/005 206/349
2002/0027092 A1 * 3/2002 Hu ..... B65D 73/0064 206/378
2004/0099621 A1 * 5/2004 Chen ..... B65D 73/0014 211/70.6
2004/0118721 A1 * 6/2004 Hernandez, Jr. ... B65D 73/0064 206/349
2004/0173485 A1 * 9/2004 Huang ..... A45F 5/021 206/349
2005/0116130 A1 * 6/2005 Hu ..... B65D 73/0064 248/309.1
2009/0026105 A1 * 1/2009 Wu ..... B65D 73/0064 206/495
2013/0313402 A1 * 11/2013 Lin ..... F16M 13/02 248/686
2015/0114862 A1 * 4/2015 Hu ..... B65D 73/0064 206/349

* cited by examiner

*Primary Examiner* — Steven A. Reynolds
(74) *Attorney, Agent, or Firm* — Alan D. Kamrath; Kamrath IP Lawfirm, P.A.

(57) ABSTRACT

A tool holder contains: a connector and a fixer. The connector includes at least one body, and each body has a first side plate and a second side plate. The connector also includes a fixing mount connecting with the first side plate and the second side plate. The first side plate has a first fitting portion, and the second side plate has a second fitting portion. The first fitting portion and the second fitting portion define a fitting zone, and the first side plate further has a first locking projection. Among the first side plate, the second side plate and the fixing mount is defined a cavity. The fixer is housed in the cavity of the connector to limit the first side plate and the second side plate to drive the first fitting portion and the second fitting portion to deform.

9 Claims, 26 Drawing Sheets

TOOL HOLDER

FIELD OF THE INVENTION

The present invention relates to a tool holder which has an anti-theft effect and removes or fits a tool easily.

BACKGROUND OF THE INVENTION

Socket sets of various sizes are mounted on a tool holder for display and storage.

Referring to FIGS. 1-2, a conventional tool holder 20 contains a plurality of bodies 21 and a fixing mount 22. Each body 21 has a fitting portion 211 extending upwardly from a top thereof and has a notch 212 defined on one side of the fitting portion 211 to accommodate a spring 213 and a steel ball 214, such that the spring 213 pushes the steel ball 214 to extend out of the one side of the fitting portion 211. Each body 21 further has a slidable block 215 arranged on a bottom thereof, and the fixing mount 22 has an accommodation groove 221 defined thereon to house the slidable block 215 of each body 21. A fitting orifice 231 of each of multiple sockets 23 is fitted with the fitting portion 211 of each body 21, and the steel ball 214 retains with a recess 232 of the fitting orifice 231 of the socket 23, thus fitting the socket 23 with each body 21.

However, as displaying the tool holder 20, each socket 23 is removed from the fitting portion of each body 21 easily by a thief. Furthermore, after purchasing the tool holder 20, the steel ball 214 is pushed by the spring 213, so it is inconvenient to remove each socket 23 from each body 21.

The present invention has arisen to mitigate and/or obviate the afore-described disadvantages.

SUMMARY OF THE INVENTION

The primary objective of the present invention is to provide a tool holder which has an anti-theft effect as displaying the tool holder.

A further objective of the present invention is to provide a tool holder in which a fixer is cut after purchasing the tool holder, so that the fixer is removed from a cavity of each body. The first side plate and the second side plate of each body drive deformation of a first fitting portion and a second fitting portion, and a first locking projection retracts in a fitting zone defined by the first fitting portion and the second fitting portion. Thus, the first locking projection removes from the tool, and the tool is rotated easily. Two diagonal corners of the tool correspond to the first locking projection to avoid scratching the first locking projection and to prolong service life of the first locking projection.

Another objective of the present invention is to provide a tool holder in which a fixer is cut after purchasing the tool holder, and the tool is revolved so that its two diagonal corners correspond to the first locking projection. Hence, the first locking projection does not retain with the tool, and the tool is removed from or is fitted with the first fitting portion and the second fitting portion easily.

To obtain the above objectives, a tool holder provided by the present invention contains: a connector and a fixer.

The connector includes at least one body, and each of the at least one body has a first side plate and a second side plate. The connector also includes a fixing mount connecting with a first end of the first side plate and a first end of the second side plate. The first side plate has a first fitting portion extending upwardly from a second end thereof, and the second side plate has a second fitting portion extending upwardly from a second end thereof. The first fitting portion and the second fitting portion define a square fitting zone, and the first side plate further has a first locking projection arranged on the first fitting portion thereof and extending out of the fitting zone. Among the first side plate, the second side plate and the fixing mount is defined a cavity, so that the first side plate and the second side plate drive the first fitting portion and the second fitting portion to deform in the cavity, and the first locking projection retracts into the fitting zone.

The fixer is housed in the cavity of the connector to limit the first side plate and the second side plate to drive the first fitting portion and the second fitting portion to deform.

DETAILED DESCRIPTION OF THE PREFERRED EMBODIMENTS

Figure 1:
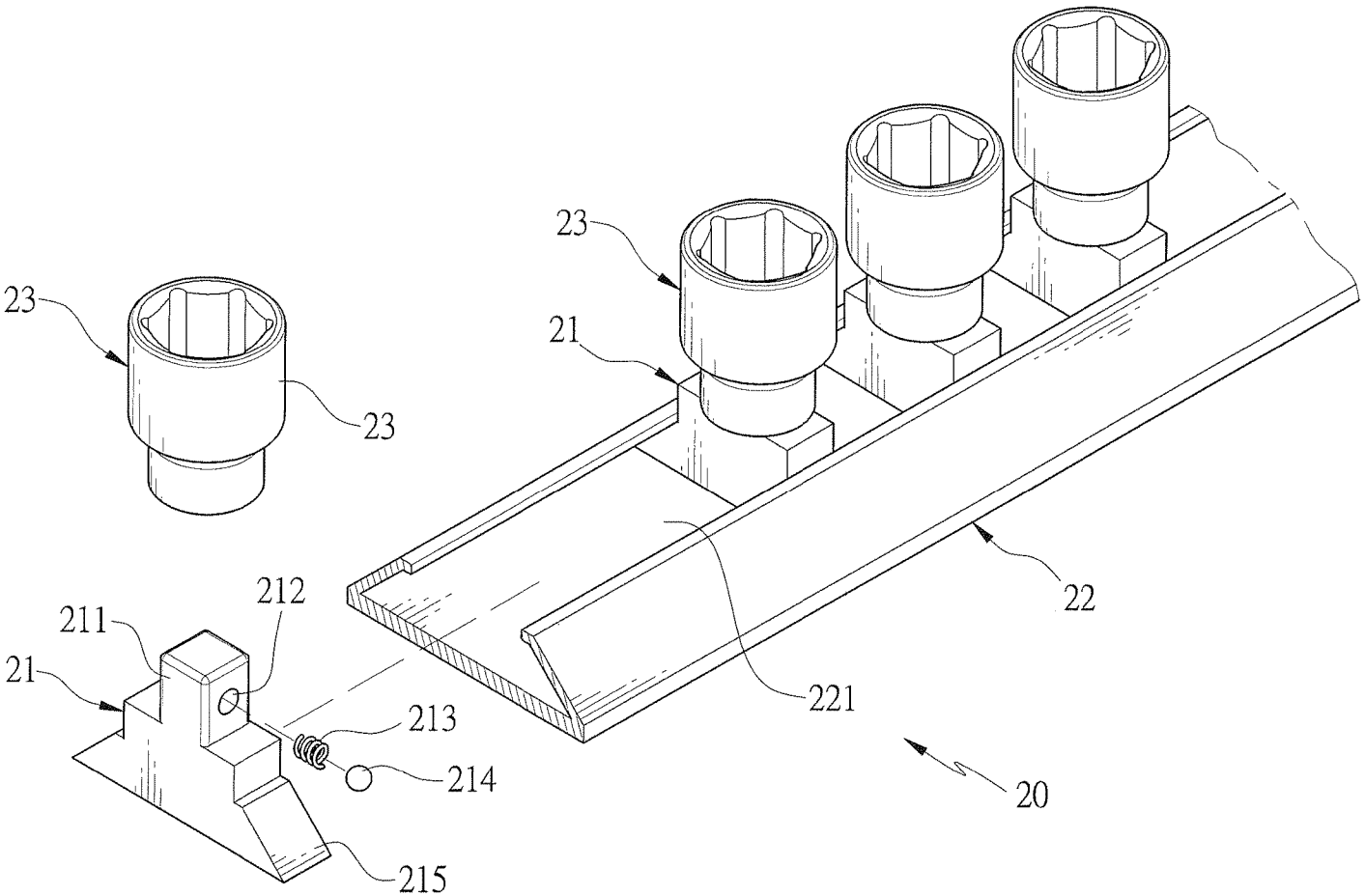
FIG. 1 PRIOR ART
FIG. 1 is a perspective view of a conventional tool holder.
Figure 2:
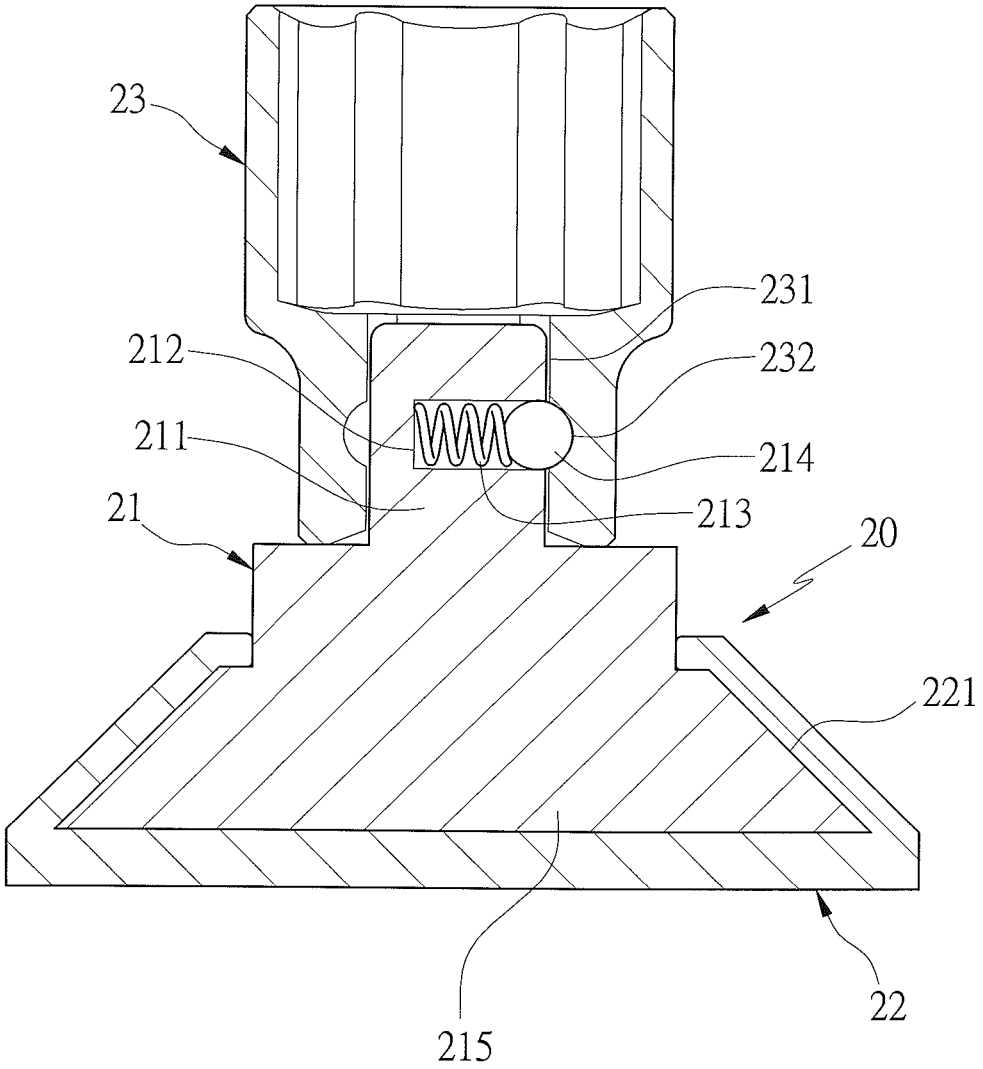
F I G . 2 PRIOR ART
FIG. 2 is a cross sectional view of the conventional tool holder.
Figure 3:
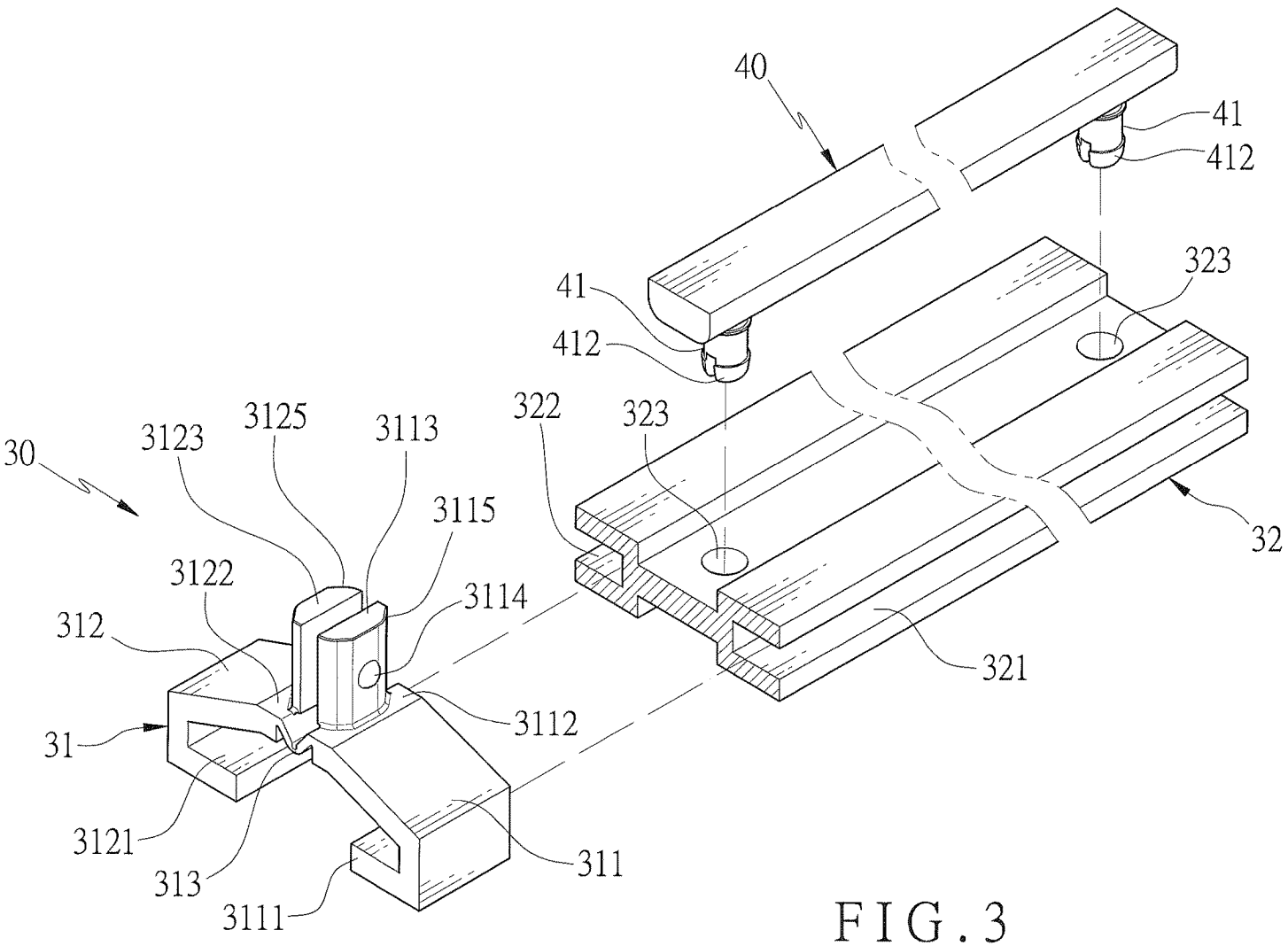
FIG. 3 is a perspective view showing the exploded components of a tool holder according to a first embodiment of the present invention.
Figure 4:
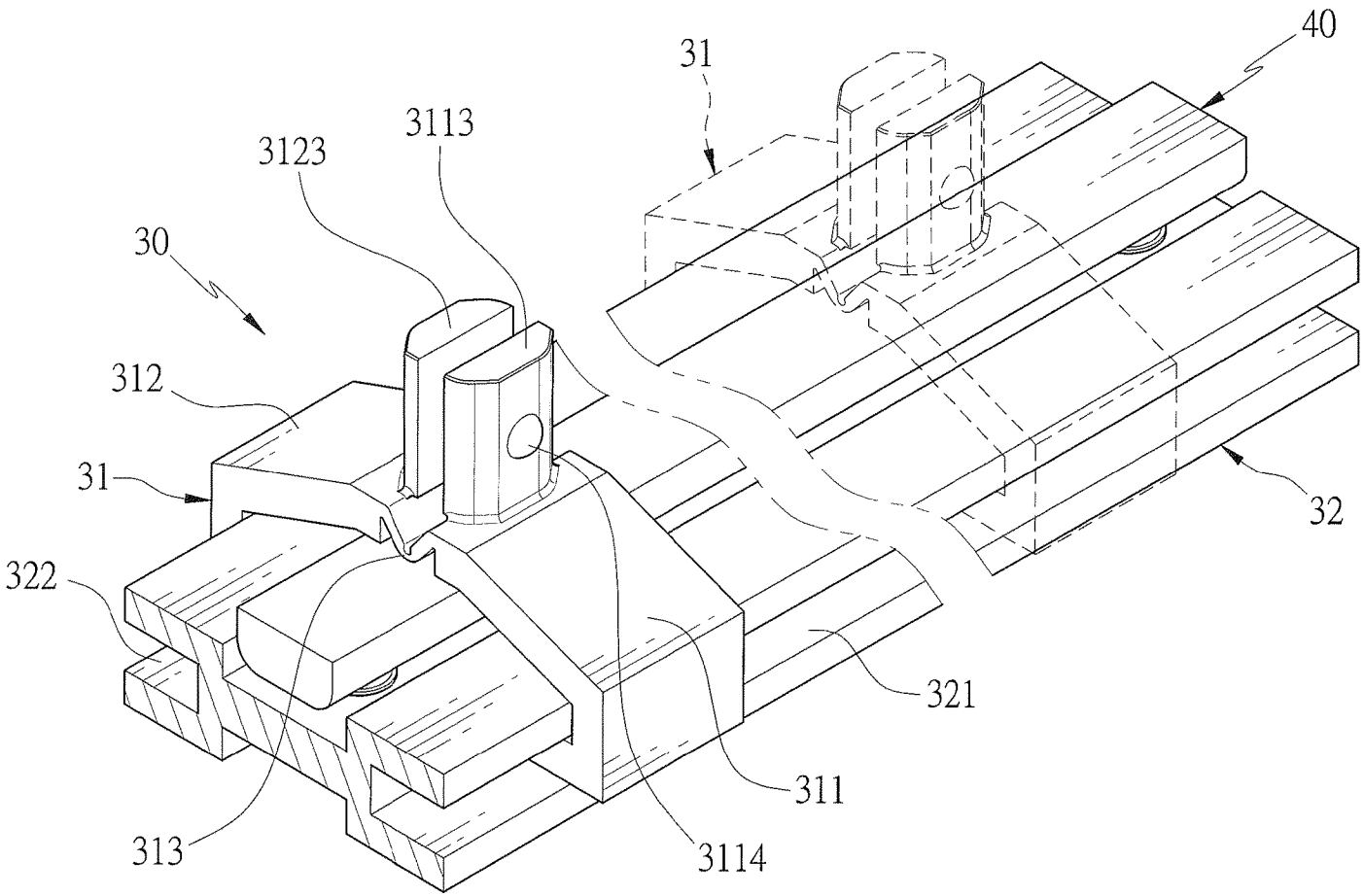
FIG. 4 is a perspective view showing the assembly of the tool holder according to the first embodiment of the present invention.
Figure 5:
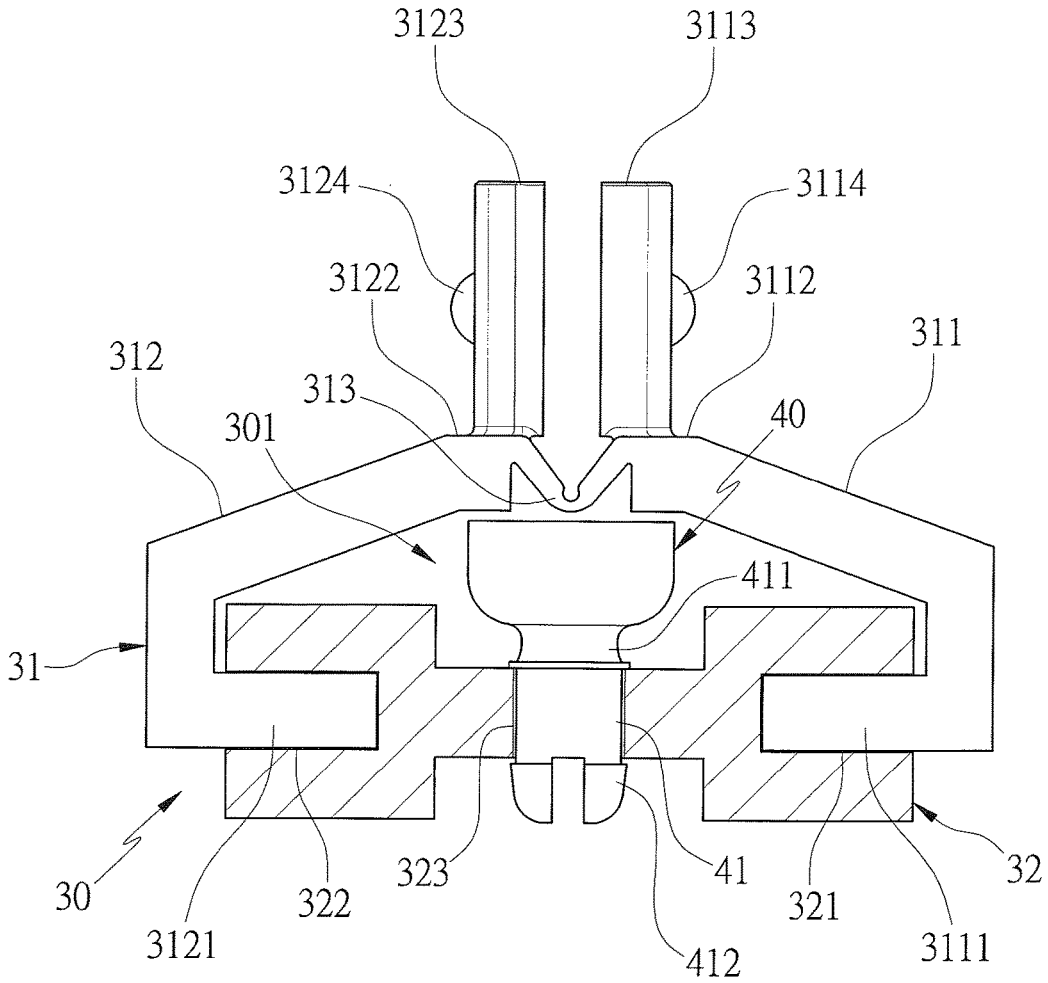
FIG. 5 is a cross sectional view showing the assembly of the tool holder according to the first embodiment of the present invention.

With reference to FIGS. 3 to 5, a tool holder according to a first embodiment of the present invention comprises: a connector 30 and a fixer 40. The connector 30 includes at least one body 31, and each of the at least one body 31 has a first side plate 311 and a second side plate 312. The connector 30 also includes a fixing mount 32 connecting with a first end of the first side plate 311 and a first end of the second side plate 312. In this embodiment, the first side plate 311 has a first extension 3111 bending inwardly from the first end thereof, and the second side plate 312 has a second extension 3121 bending inwardly from the first end thereof. The fixing mount 32 has a first accommodation groove 321 defined on a first side thereof to fit with the first extension 3111 of the first side plate 311, and the fixing mount 32 has a second accommodation groove 322 defined on a second side thereof to fit with the second extension 3121 of the second side plate 312. The fixing mount 32 has a predetermined length to fit with a plurality of bodies 31. The fixing mount 32 further has two covers arranged on two ends thereof respectively to limit the plurality of bodies 31 on the fixing mount 32. Since the two covers are a wellknown prior art, further remarks are omitted. The first side plate 311 and the second side plate 312 of each body 31 obliquely extend inward. In this embodiment, between a second end of the first side plate 311 and a second end of the second side plate 312 is defined a returning section 313 in a V shape. The returning section 313 is forced to deform flexibly, so that the first side plate 311 and the second side plate 312 have a recovery flexibility. The first side plate 311 also has a first stop portion 3112 formed on the second end thereof and has a first fitting portion 3113 extending upwardly from the first stop portion 3112, and the second side plate 312 also has a second stop portion 3122 formed on the second end thereof and has a second fitting portion 3123 extending upwardly from the second stop portion 3122. The first fitting portion 3113 and the second fitting portion 3123 define a square fitting zone for fitting a tool. The first side plate 311 further has a first locking projection 3114 arranged on the first fitting portion 3113 thereof and extending out of the fitting zone defined by the first fitting portion 3113 and the second fitting portion 3123. In this embodiment, the second side plate 312 has a second locking projection 3124 arranged on the second fitting portion 3123 thereof and corresponding to the first locking projection 3114. When the first fitting portion 3113 and the second fitting portion 3123 fit with the tool, the first stop portion 3112 and the second stop portion 3122 limit the tool, and the first locking projection 3114 and the second locking projection 3124 engage the tool. The first fitting portion 3113 has two first tilted faces 3115 defined on two edges of an outer rim thereof respectively, and the second fitting portion 3123 has two second tilted faces 3125 defined on two edges of an outer rim thereof respectively to guide the tool to rotate 45 degrees. Among the first side plate 311, the second side plate 312 and the fixing mount 32 is defined a cavity 301. The first side plate 311 and the second side plate 312 drive the first fitting portion 3113 and the second fitting portion 3123 to deform in the cavity 301. As the first side plate 311 and the second side plate 312 are pressed, the first locking projection 3114 and the second locking projection 3124 retract into the fitting zone defined by the first fitting portion 3113 and the second fitting portion 3123. The fixer 40 is housed in the cavity 301 of the connector 30 to limit deformation of the first side plate 311 and the second side plate 312 of said each body 31, thus obtaining an anti-theft effect of the tool. In this embodiment, the fixer 40 includes two columns 41 extending downwardly from two end portions thereof respectively, and each column 41 has a neck 411 formed on a first end thereof and a flexible fastening tab 412 arranged on a second end thereof. The fixing mount 32 further has two orifices 323, and each orifice 323 is configured to accommodate the fastening tab 412 of each column 41. The fixer 40 is mounted in the cavity 301 of the connector 30 to limit the deformation of the first side plate 311 and the second side plate 312 of each body 31, thus obtaining the anti-theft effect of the tool. Preferably, the neck 411 of each column 41 is cut to remove the fixer 40 easily, after the user purchases the tool holder.

Figure 6:
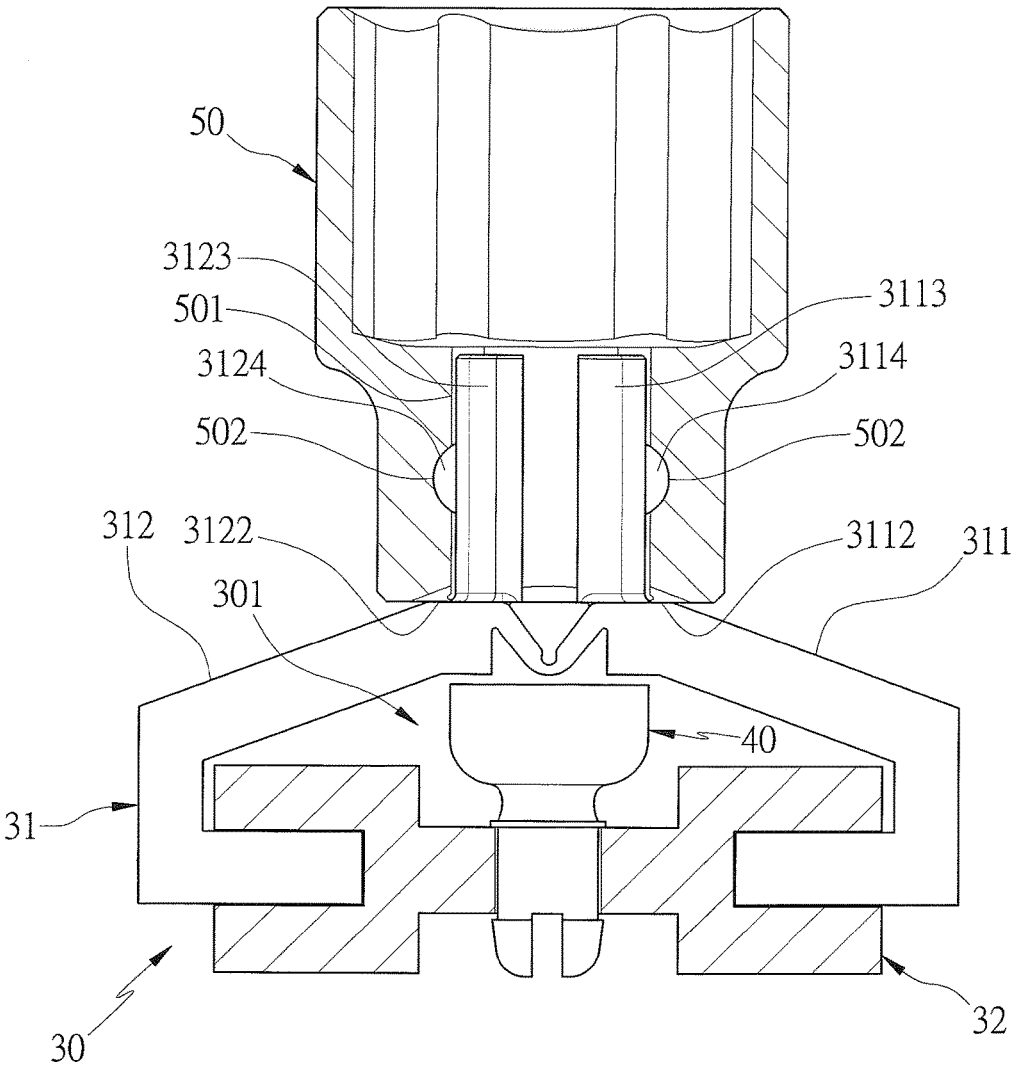
FIGS. 6 to 14 are cross sectional views respectively showing the operation of the tool holder according to the first embodiment of the present invention.

Referring to FIG. 6, the tool is a socket or a connection rod. Taking the socket 50 for example, it has a square hole 501 defined on one end thereof to fit with the fitting zone defined by the first fitting portion 3113 and the second fitting portion 3123 of each body 31. The square hole 501 has four retaining recesses 502 individually arranged on four peripheral walls thereof, and each retaining recess 502 retains with the first locking projection 3114 or the second locking projection 3124. When the square hole 501 of the socket 50 is forced onto the first fitting portion 3113 and the second fitting portion 3123 of each body 31, an end portion of the socket 50 is limited on the first stop portion 3112 of the first side plate 311 and the second stop portion 3122 of the second side plate 312. Each retaining recess 502 of the socket 50 retains with the first locking projection 3114 or the second locking projection 3124, and the socket 50 fits with the first fitting portion 3113 and the second fitting portion 3123 of said each body 31. Because the fixer 40 is housed in the cavity 301 of the connector 30 to limit the deformation of the first side plate 311 and the second side plate 312, the first locking projection 3114 and the second locking projection 3124 respectively retain with two of the four retaining recesses 502 of the socket 50. The socket 50 cannot not be pulled out of the first fitting portion 3113 and the second fitting portion 3123 of each body 31, thus obtaining the anti-theft effect of the socket 50.

Figure 7:
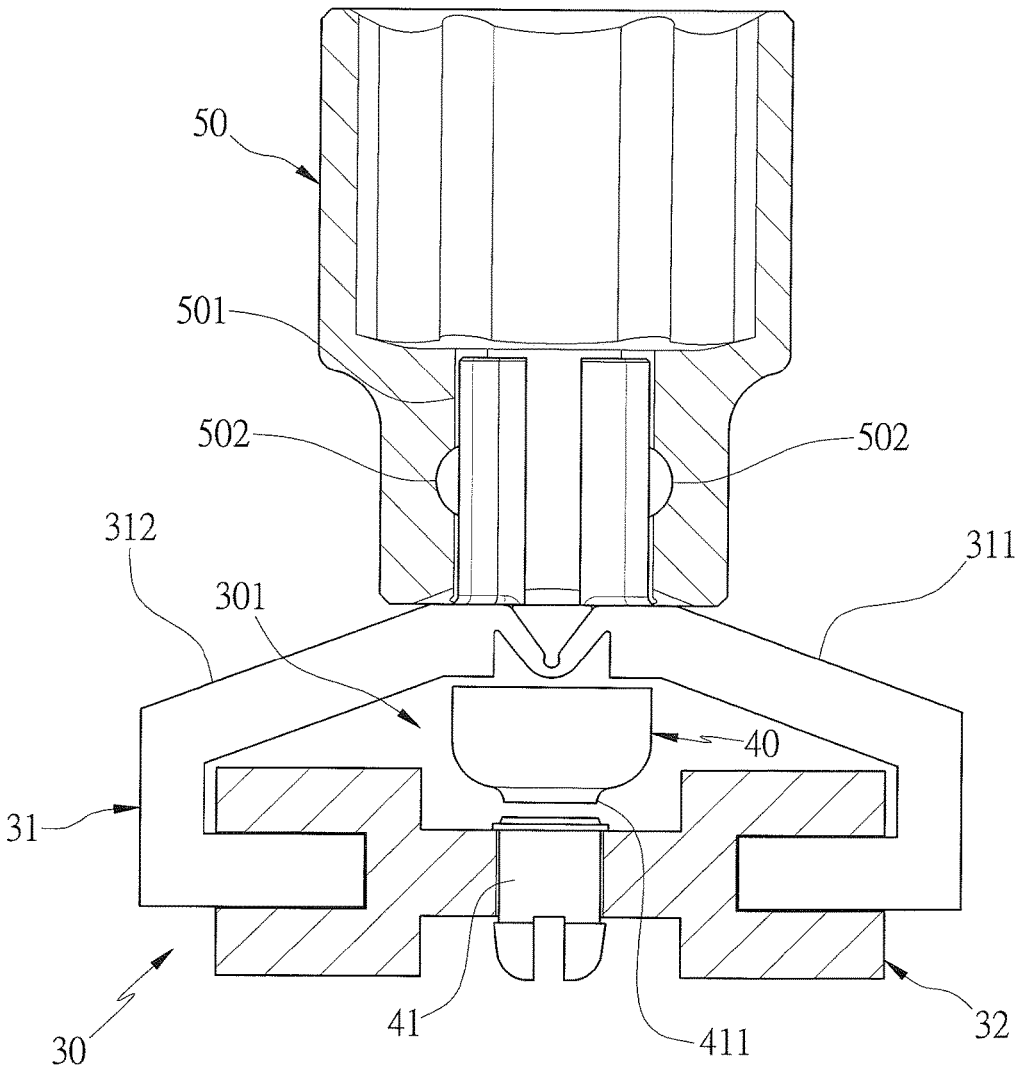
Figure 8:
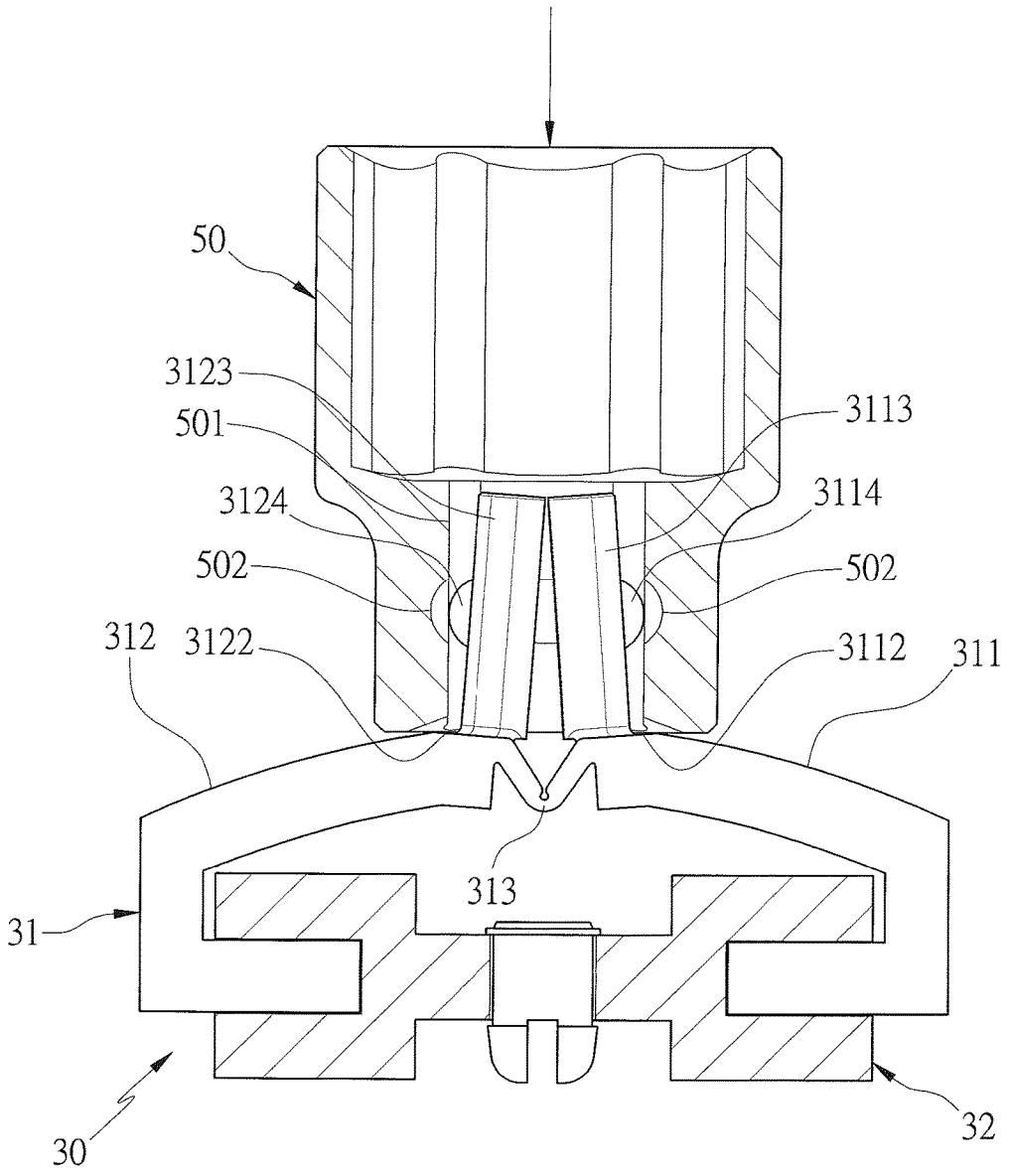
Figure 9:
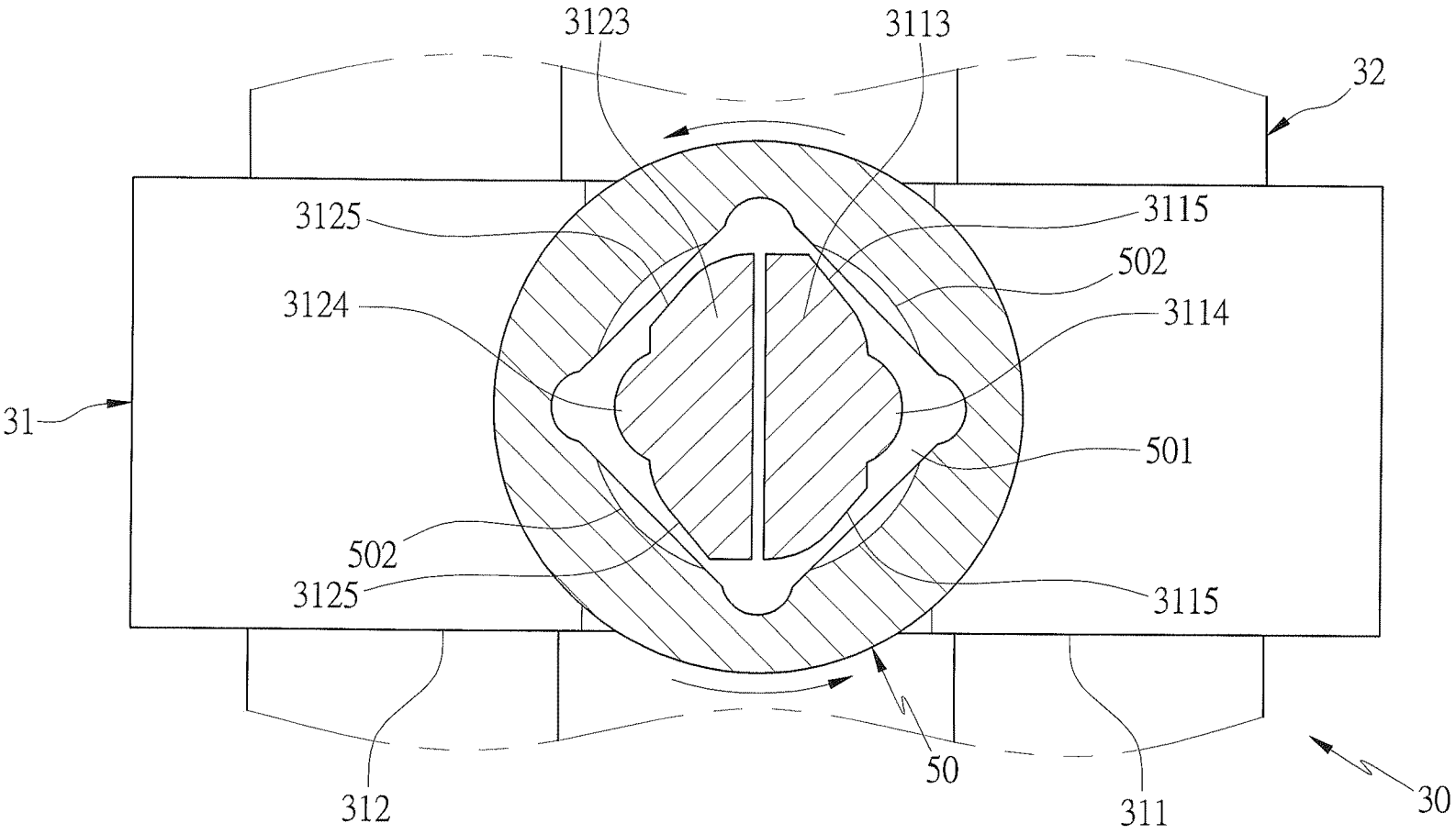

As shown in FIG. 7, the neck 411 of the column 41 of the fixer 40 is cut. The fixer 40 is removed from the cavity 301 of each body 31, and the deformation of the first side plate 311 and the second side plate 312 of each body 31 is released. As illustrated in FIG. 8, the socket 50 is pressed to abut against the first stop portion 3112 of the first side plate 311 and the second stop portion 3122 of the second side plate 312. The first side plate 311 and the second side plate 312 drive the deformation of the first fitting portion 3113 and the second fitting portion 3123, and the first locking projection 3114 and the second locking projection 3124 retract into the fitting zone defined by the first fitting portion 3113 and the second fitting portion 3123. Hence, the first locking projection 3114 and the second locking projection 3124 remove from the two retaining recesses 502 of the socket 50 individually. With reference to FIG. 9, the first locking projection 3114 and the second locking projection 3124 retract into the fitting zone defined by the first fitting portion 3113 and the second fitting portion 3123. The first fitting portion 3113 has the two first tilted faces 3115, and the second fitting portion 3123 has the two second tilted faces 3125. Thus, the socket 50 is rotated 45 degrees easily, and two diagonal corners of the square hole 501 of the socket 50 are revolved to correspond to the first locking projection 3114 and the second locking projection 3124 respectively.

Figure 10:
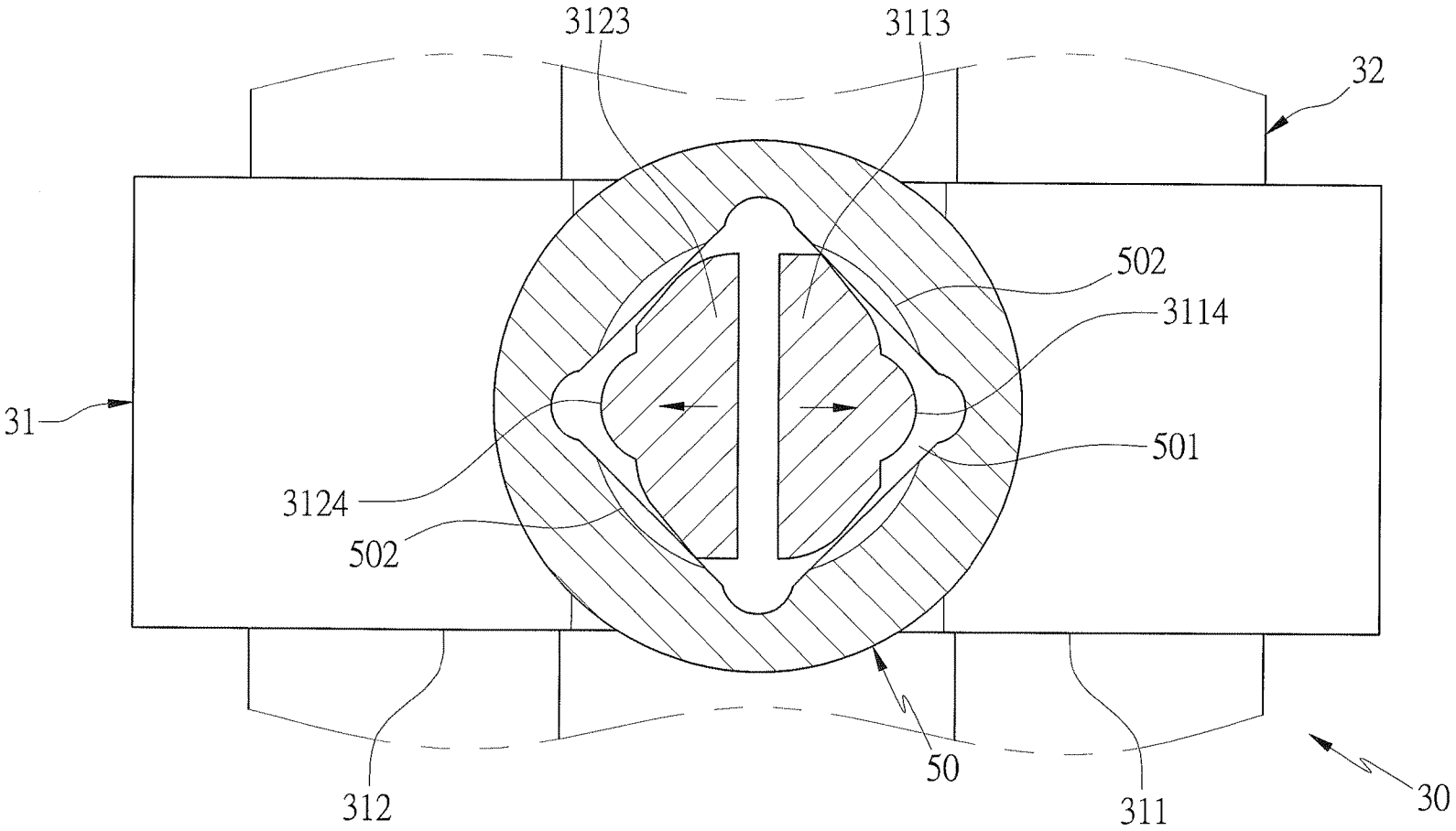

Referring to FIG. 10, when stopping pressing the socket 50, the first side plate 311 and the second side plate 312 of each body 31 return to their original positions individually, and the first fitting portion 3113, the second fitting portion 3123, the first locking projection 3114, and the second locking projection 3124 return back to their original positions respectively. Due to the first locking projection 3114 and the second locking projection 3124 corresponding to the two diagonal corners of the square hole 501 of the socket 50, and due to a distance between the two diagonal corners of the square hole 501 being more than an extending distance of each of the first locking projection 3114 and the second locking projection 3124, the first locking projection 3114 and the second locking projection 3124 do not retain with the socket 50. Hence, the socket 50 is removed easily.

Figure 11:
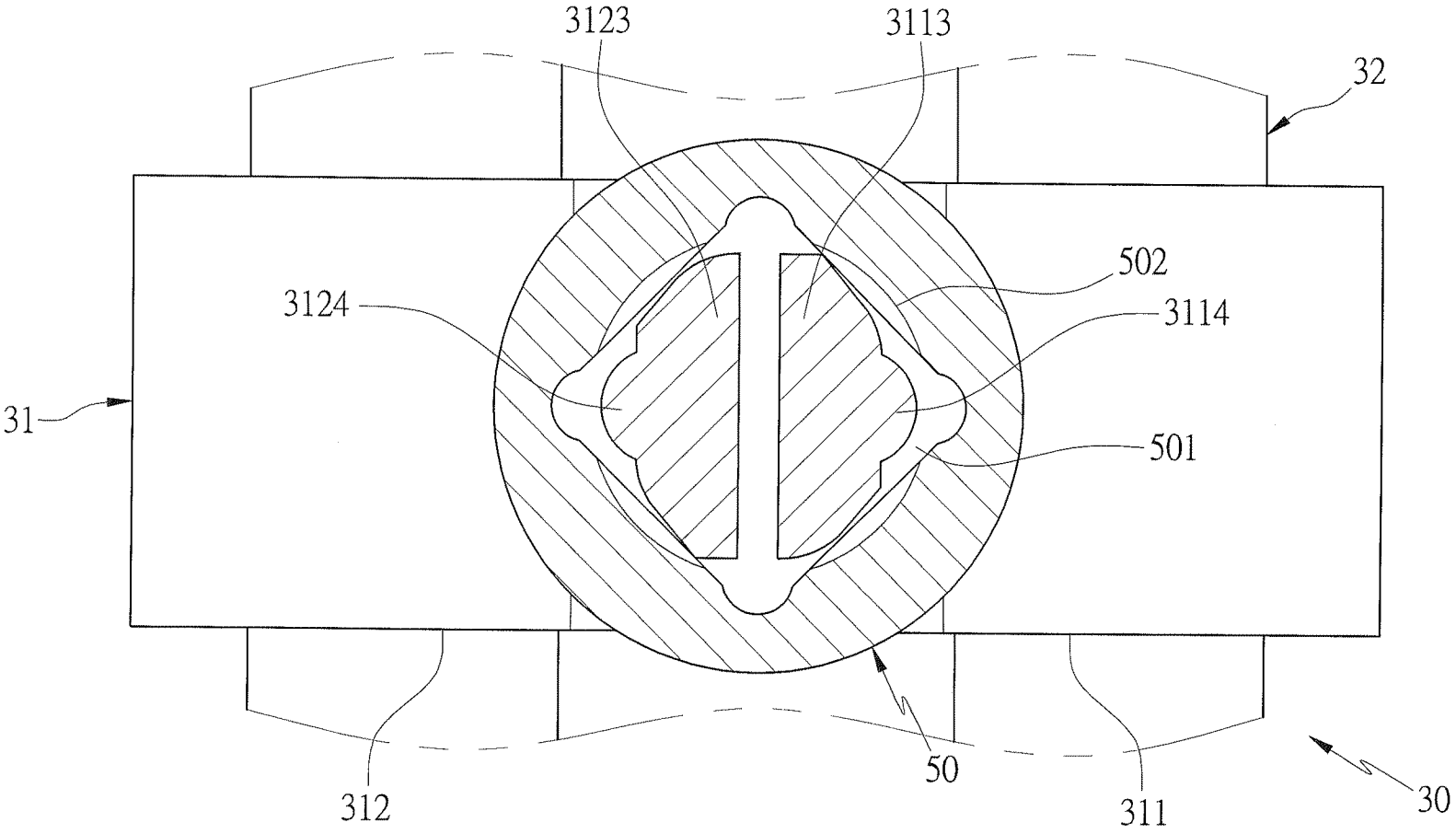
Figure 12:
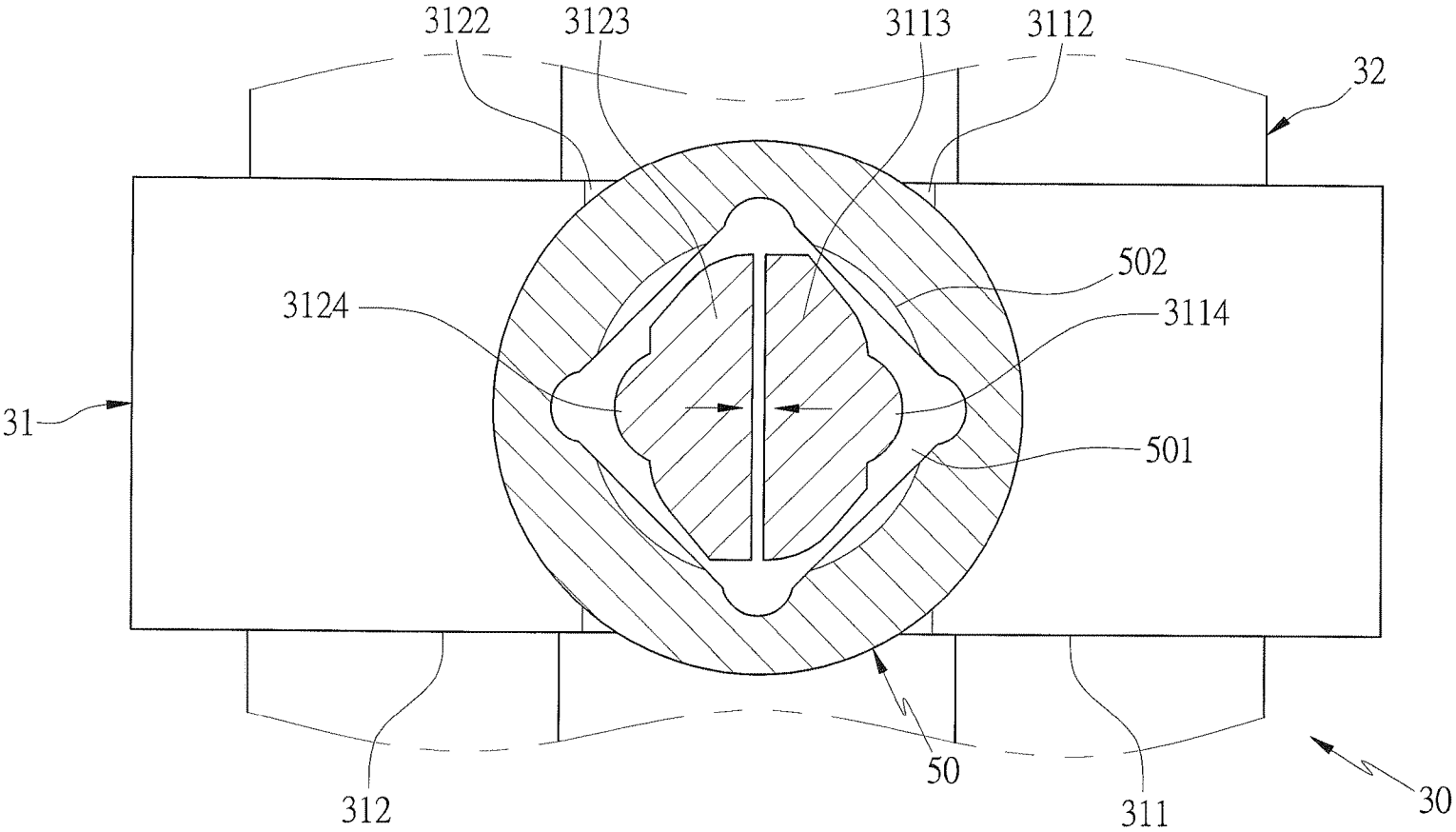
Figure 13:
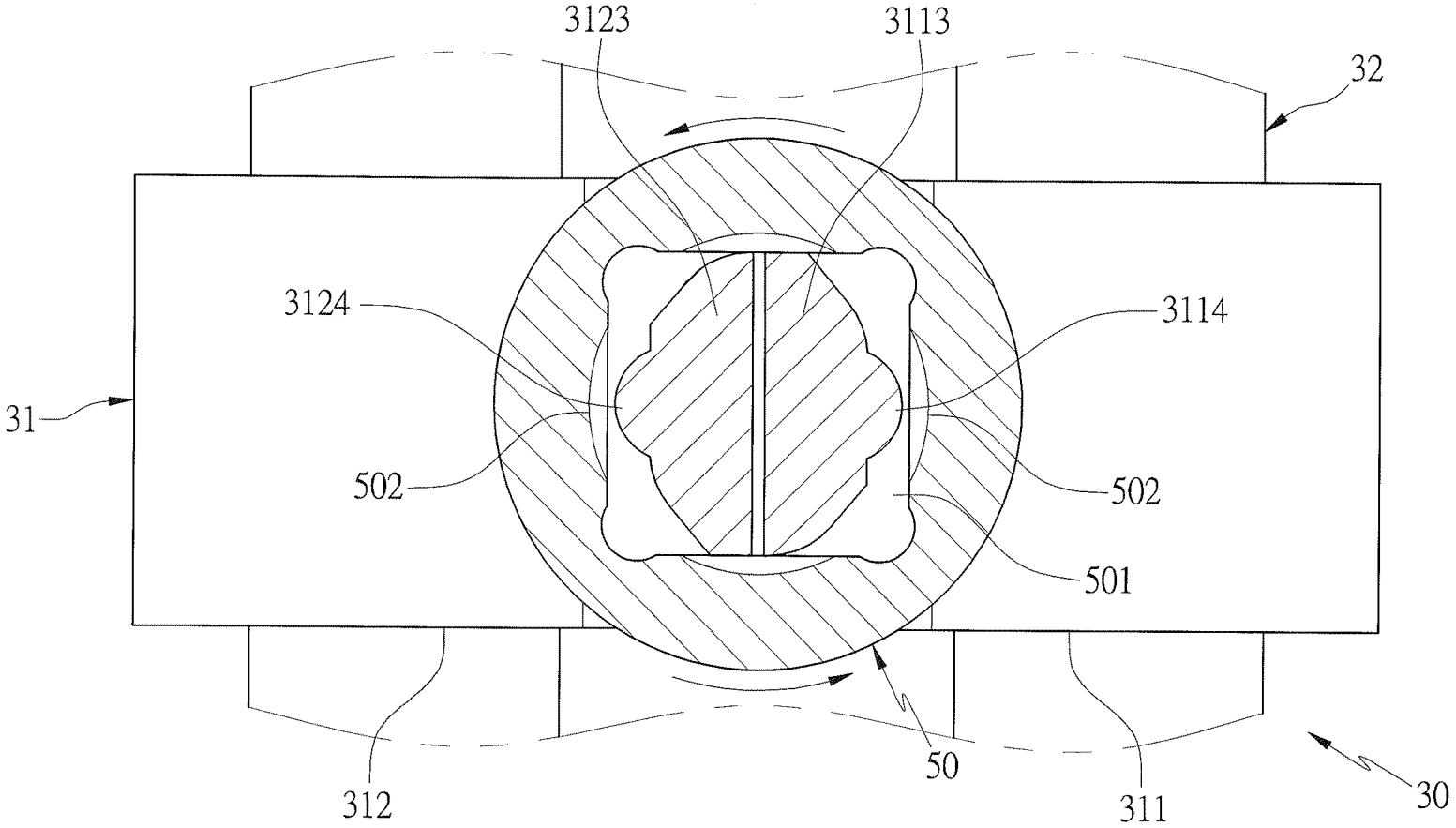
Figure 14:
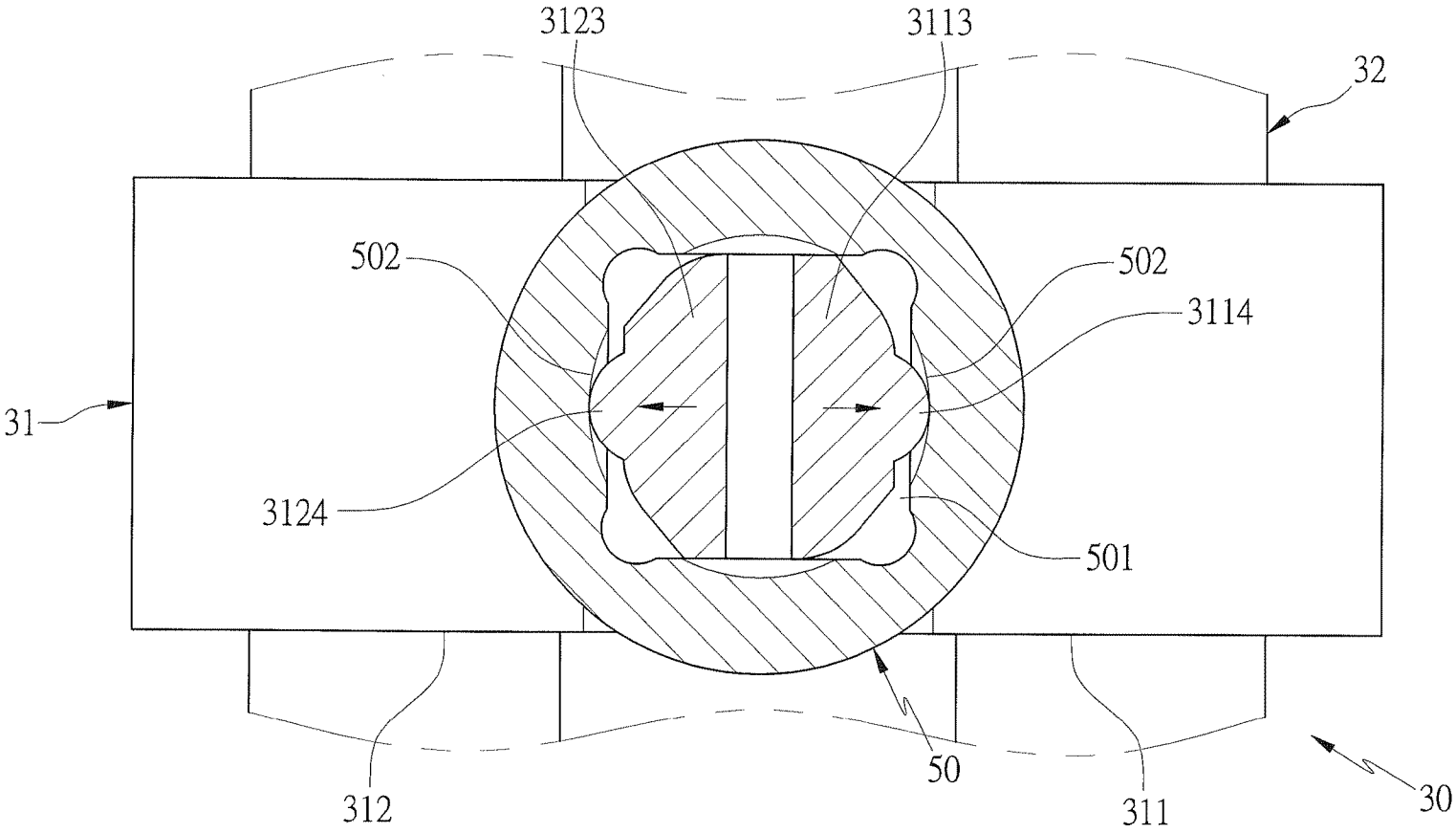

As shown in FIG. 11, the socket 50 is fixed on the connector 30. The two diagonal corners of the square hole 501 of the socket 50 correspond to the first locking projection 3114 and the second locking projection 3124 respectively. As the distance between the two diagonal corners of the square hole 501 is more than the extending distance of each of the first locking projection 3114 and the second locking projection 3124, the square hole 501 of the socket 50 fits with the first fitting portion 3113 and the second fitting portion 3123. As illustrated in FIG. 12, after using the socket 50, it is pressed so that its end portion abuts against the first stop portion 3112 of the first side plate 311 and the second stop portion 3122 of the second side plate 312, and the first side plate 311 and the second side plate 312 drive the deformation of the first fitting portion 3113 and the second fitting portion 3123. Hence, the first locking projection 3114 and the second locking projection 3124 retract into the fitting zone defined by the first fitting portion 3113 and the second fitting portion 3123. With reference to FIG. 13, the socket 50 is rotated 45 degrees so that the two retaining recesses 502 of the socket 50 correspond to the first locking projection 3114 and the second locking projection 3124 individually. Referring further to FIG. 14, when stopping pressing the socket 50, the first side plate 311 and the second side plate 312 of said each body 31 return to their original positions respectively, and the first fitting portion 3113, the second fitting portion 3123, the first locking projection 3114, and the second locking projection 3124 return to their original positions individually. Hence, the first locking projection 3114 and the second locking projection 3124 individually retain with the two retaining recesses 502, thus re-fitting the socket 50 with the connector 30.

Figure 15:
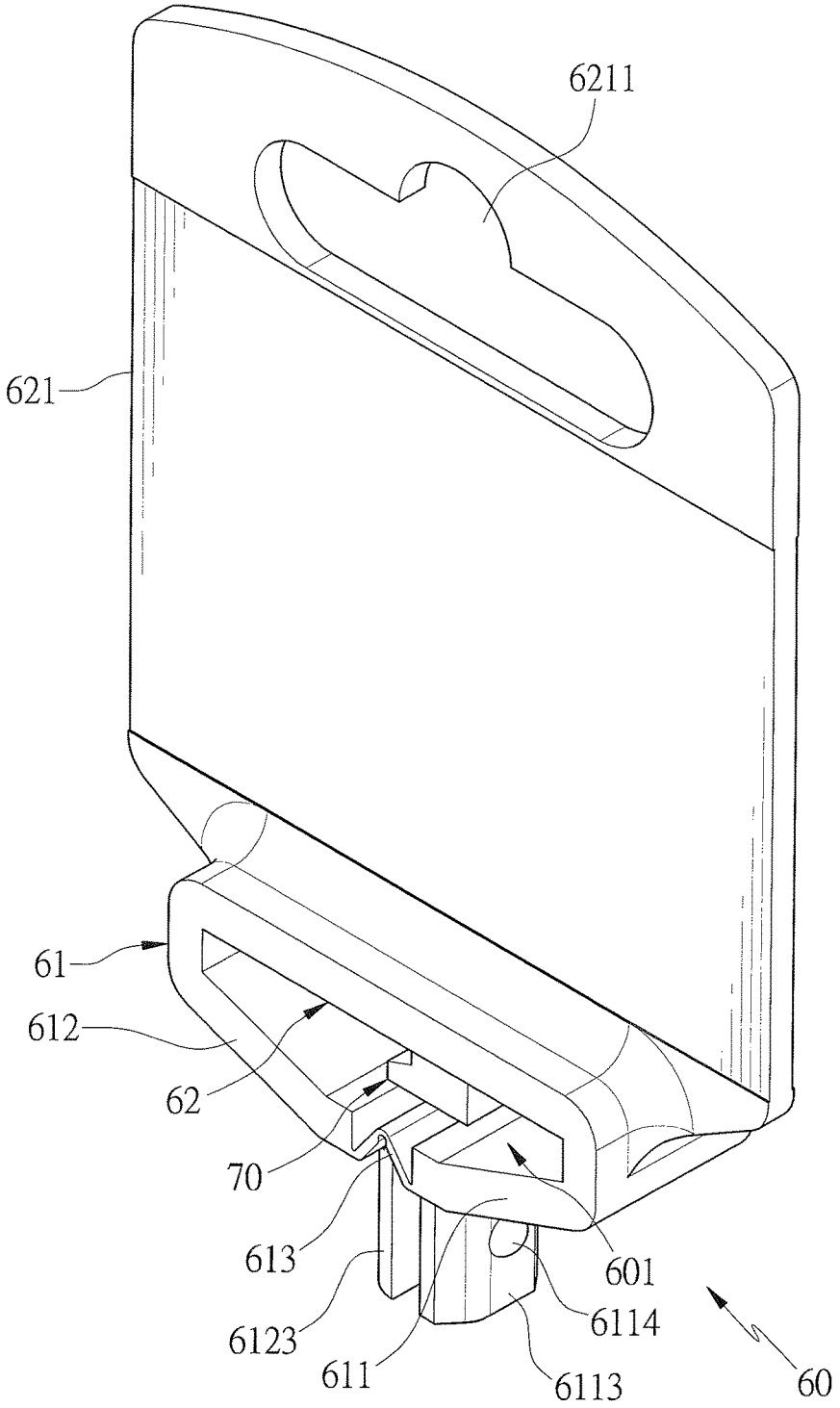
FIG. 15 is a perspective view showing the assembly of a tool holder according to a second embodiment of the present invention.
Figure 16:
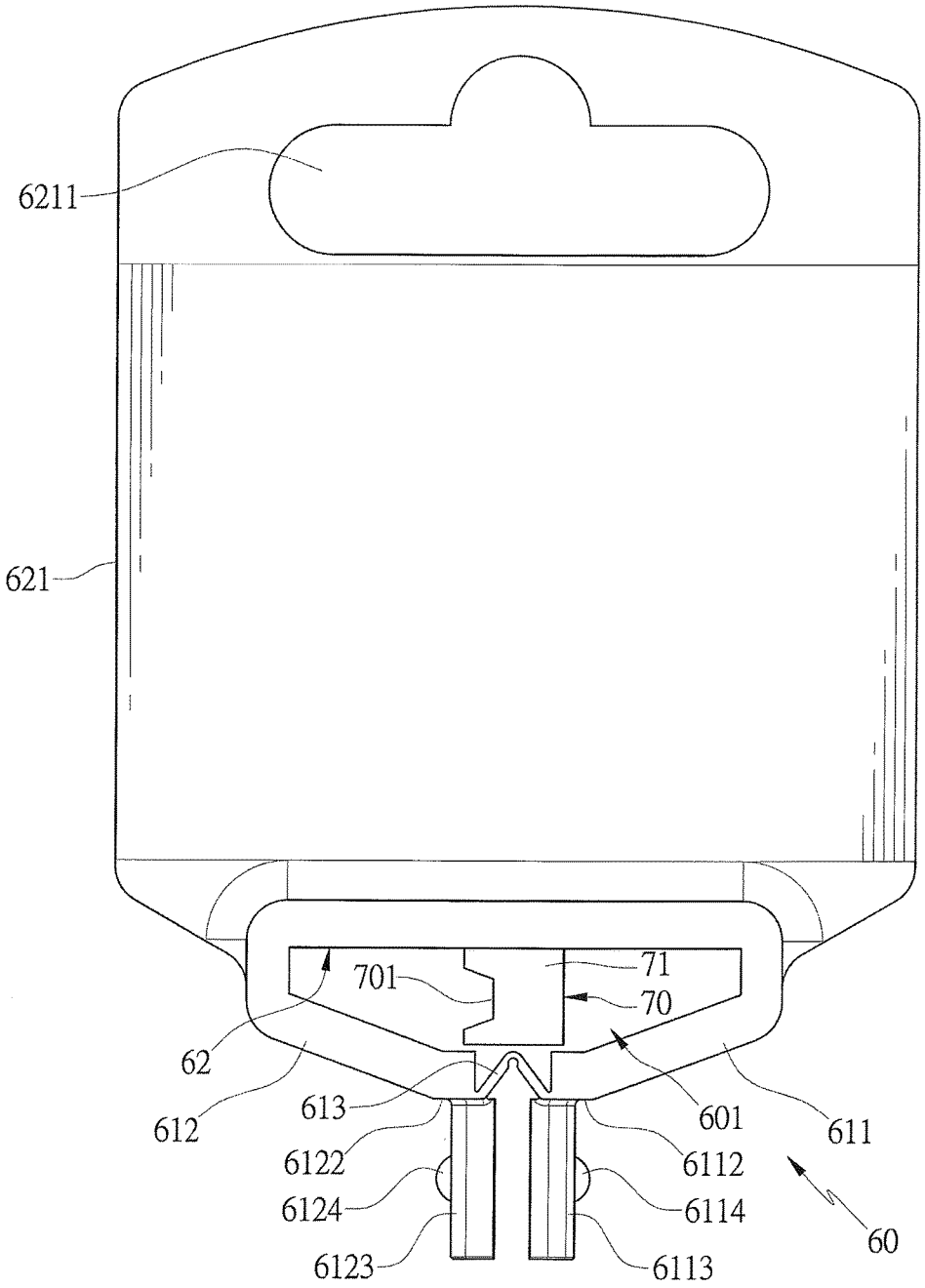
FIG. 16 is a side plan view showing the assembly of the tool holder according to the second embodiment of the present invention.
Figure 17:
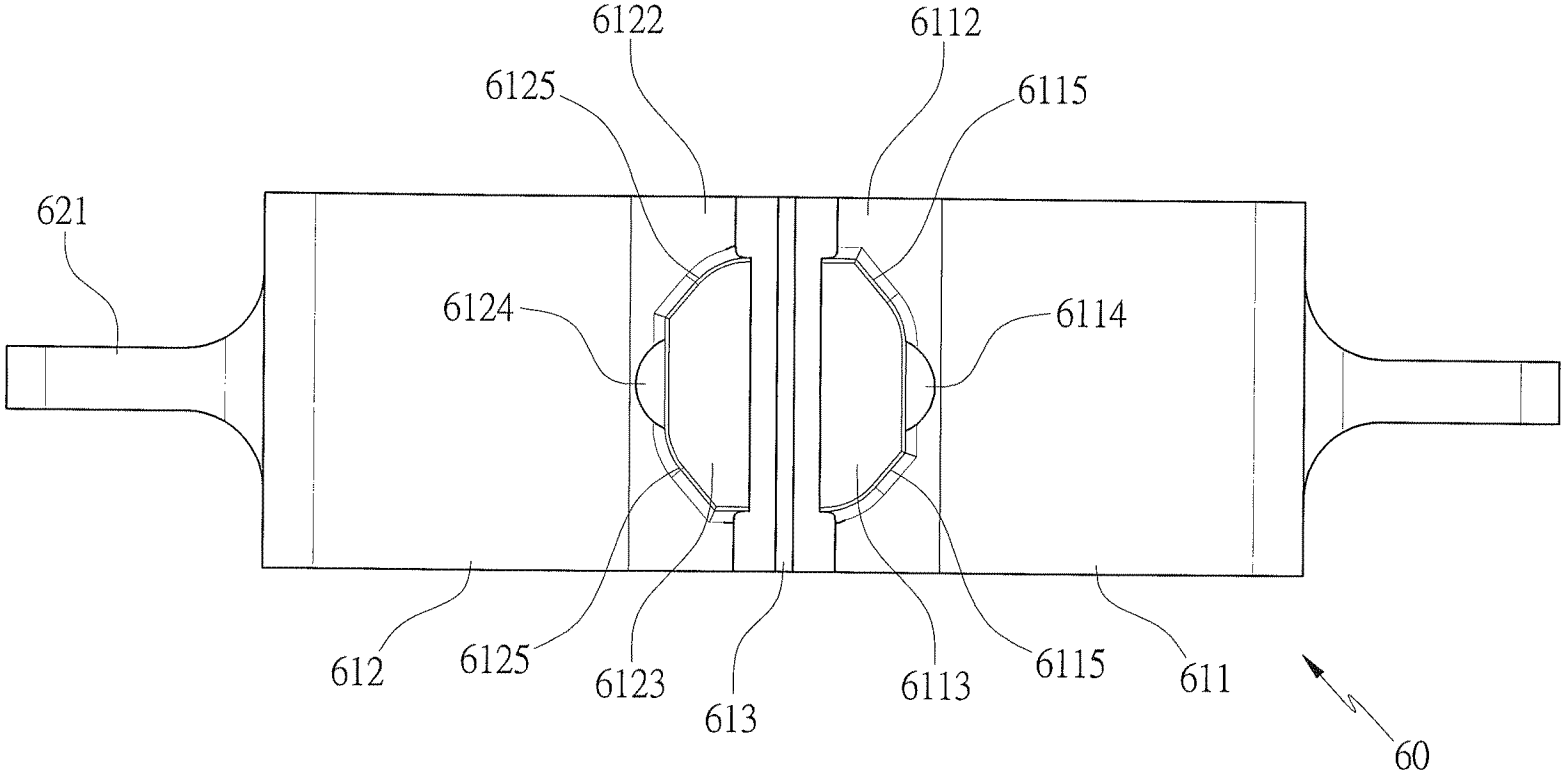
FIG. 17 is another side plan view showing the assembly of the tool holder according to the second embodiment of the present invention.

With reference to FIGS. 15 to 17, a tool holder according to a second embodiment of the present invention comprises: a connector 60 and a fixer 70. The connector 60 includes at least one body 61, and each of the at least one body 61 has a first side plate 611 and a second side plate 612. In this embodiment, a first end of the first side plate 611 and a first end of the second side plate 612 are integrally connected with a fixing mount 62, and the fixing mount 62 has a positioning piece 621 on which a hanging aperture 6211 is defined. The first side plate 611 and the second side plate 612 of each body 61 obliquely extend inward. In this embodiment, between a second end of the first side plate 611 and a second end of the second side plate 612 is defined a returning section 613 in a V shape. The returning section 613 is forced to deform flexibly, so that the first side plate 611 and the second side plate 612 have a recovery flexibility. The first side plate 611 also has a first stop portion 6112 formed on the second end thereof and has a first fitting portion 6113 extending upwardly from the first stop portion 6112, and the second side plate 612 also has a second stop portion 6122 formed on the second end thereof and has a second fitting portion 6123 extending upwardly from the second stop portion 6122. The first fitting portion 6113 and the second fitting portion 6123 define a square fitting zone for fitting a tool. The first side plate 611 further has a first locking projection 6114 arranged on the first fitting portion 6113 thereof and extending out of the fitting zone defined by the first fitting portion 6113 and the second fitting portion 6123. In this embodiment, the second side plate 612 has a second locking projection 6124 arranged on the second fitting portion 6123 thereof and corresponding to the first locking projection 6114. When the first fitting portion 6113 and the second fitting portion 6123 fit with the tool, the first stop portion 6112 and the second stop portion 6122 limit the tool, and the first locking projection 6114 and the second locking projection 6124 engage the tool. The first fitting portion 6113 has two first tilted faces 6115 defined on two edges of an outer rim thereof respectively, and the second fitting portion 6123 has two second tilted faces 6125 defined on two edges of an outer rim thereof respectively to guide the tool to rotate 45 degrees. Among the first side plate 611, the second side plate 612 and the fixing mount 62 is defined a cavity 601. The first side plate 611 and the second side plate 612 drive the first fitting portion 6113 and the second fitting portion 6123 to deform in the cavity 601. As the first side plate 611 and the second side plate 612 are pressed, the first locking projection 6114 and the second locking projection 6124 retract into the fitting zone defined by the first fitting portion 6113 and the second fitting portion 6123. The fixer 70 is housed in the cavity 601 of the connector 60 to limit deformation of the first side plate 611 and the second side plate 612 of each body 61, thus obtaining an anti-theft effect of the tool. In this embodiment, one end of the fixer 70 integrally connects with the fixing mount 62. Hence, the fixer 70 is mounted in the cavity 601 of the connector 60 to limit the deformation of the first side plate 611 and the second side plate 612 of each body 61, thus obtaining the anti-theft effect of the tool. The fixer 70 includes a neck 701 formed on a peripheral side thereof, such that the neck 701 of said each column 71 is cut so that the fixer 70 is removed easily, after the user purchases the tool holder.

Figure 18:
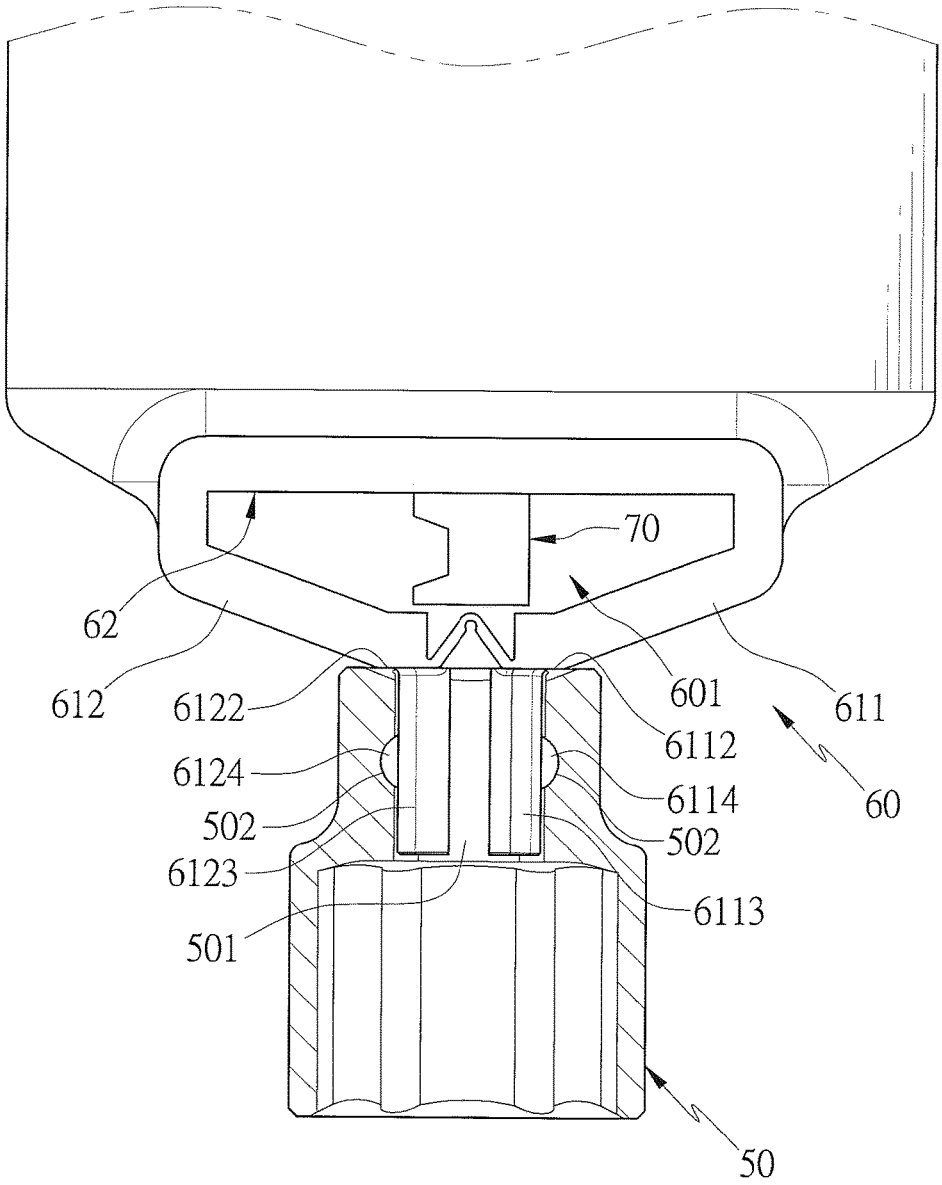
FIGS. 18 to 26 are cross sectional views respectively showing the operation of the tool holder according to the second embodiment of the present invention.

Referring to FIG. 18, when the square hole 501 of the socket 50 is forced onto the first fitting portion 6113 and the second fitting portion 6123 of said each body 61, an end portion of the socket 50 is limited on the first stop portion 6112 of the first side plate 611 and the second stop portion 6122 of the second side plate 612. Each retaining recess 502 of the socket 50 retains with the first locking projection 6114 or the second locking projection 6124, and the socket 50 fits with the first fitting portion 6113 and the second fitting portion 6123 of said each body 61. Because the fixer 70 is housed in the cavity 601 of the connector 60 to limit the deformation of the first side plate 611 and the second side plate 612, the first locking projection 6114 and the second locking projection 6124 respectively retain with two of the four retaining recesses 502 of the socket 50. The socket 50 cannot be pulled out of the first fitting portion 6113 and the second fitting portion 6123 of each body 61, thus obtaining the anti-theft effect of the socket 50.

Figure 19:
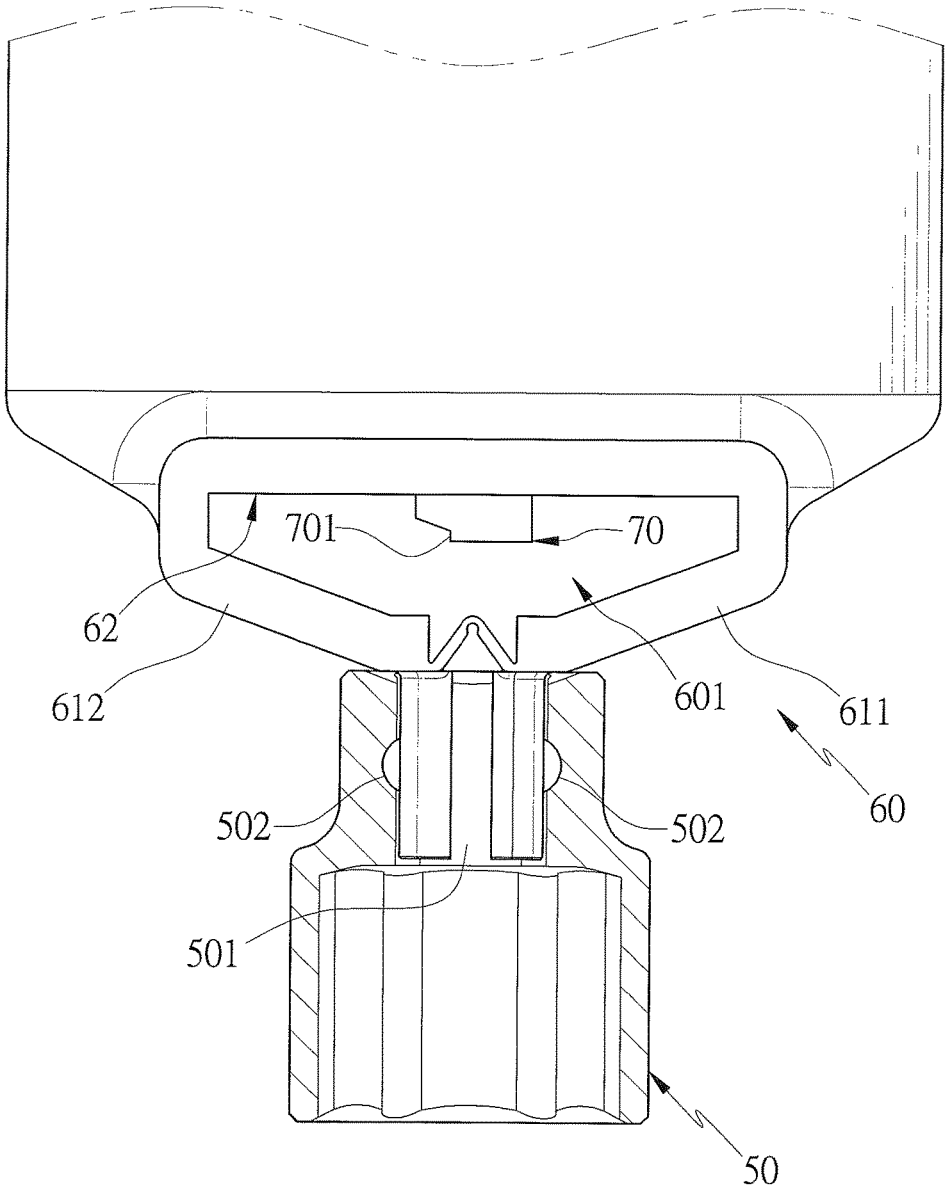
Figure 20:
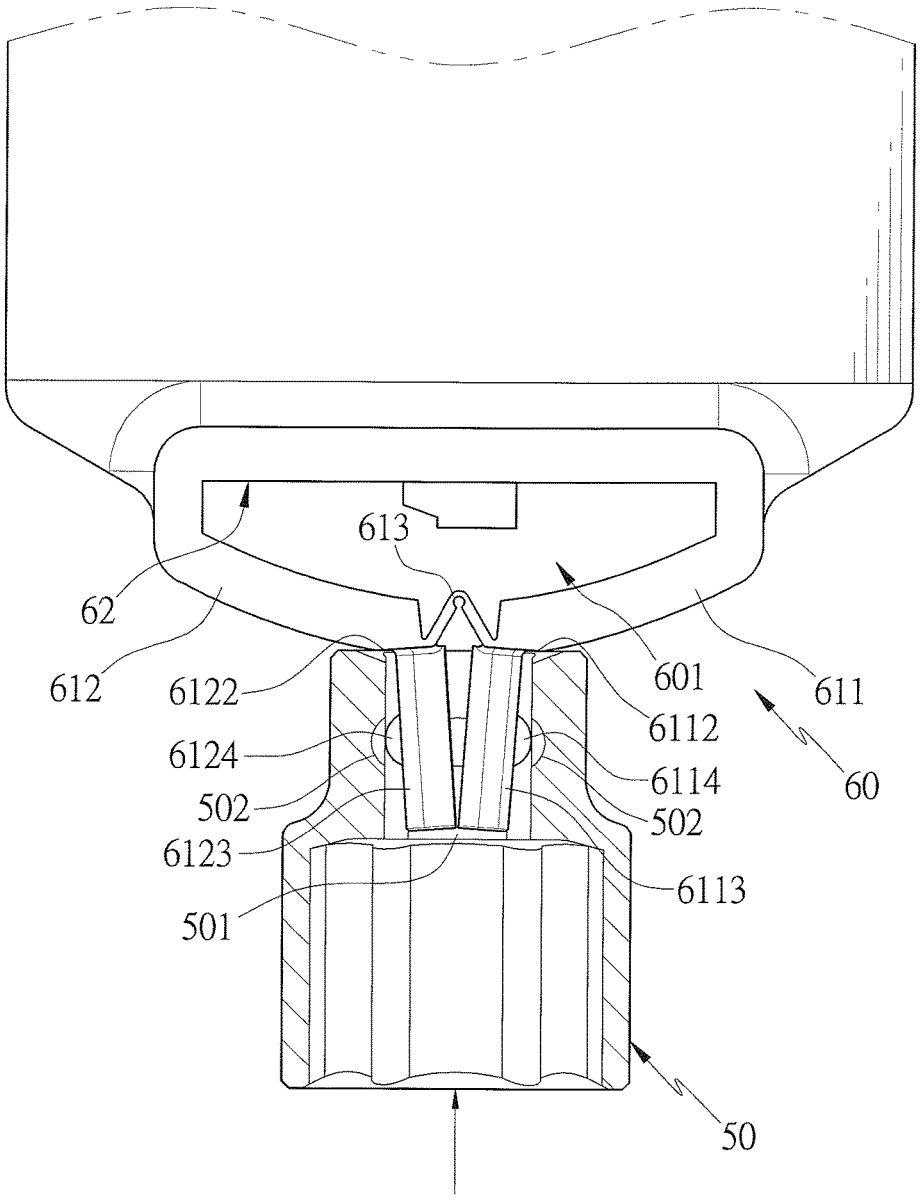
Figure 21:
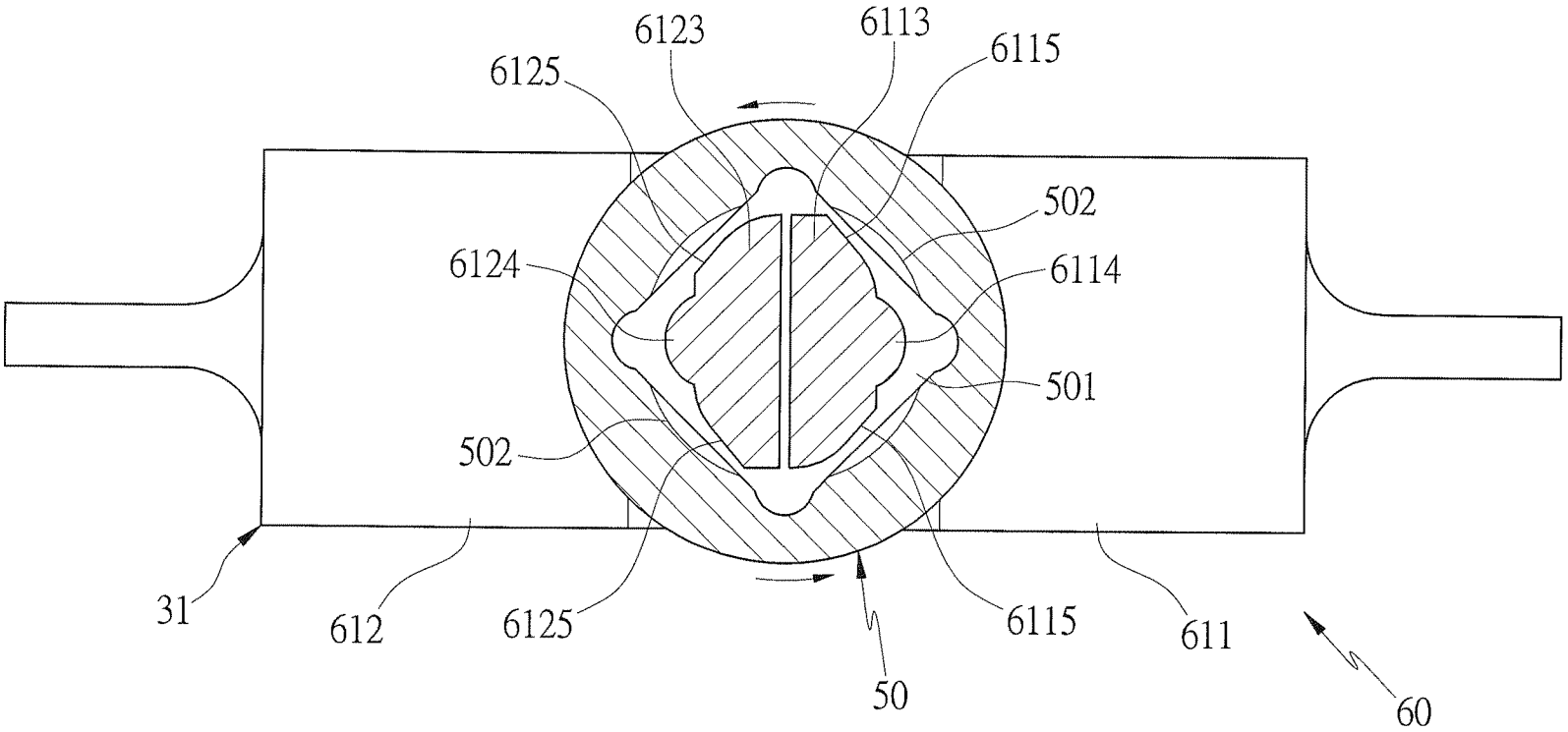

As shown in FIG. 19, the neck 701 of the fixer 70 is cut. Thus, the fixer 70 is removed from the cavity 601 of each body 61, and the deformation of the first side plate 611 and the second side plate 612 of each body 61 is released. As illustrated in FIG. 20, the socket 50 is pressed to abut against the first stop portion 6112 of the first side plate 611 and the second stop portion 6122 of the second side plate 612. The first side plate 611 and the second side plate 612 drive the deformation of the first fitting portion 6113 and the second fitting portion 6123, and the first locking projection 6114 and the second locking projection 6124 retract into the fitting zone defined by the first fitting portion 6113 and the second fitting portion 6123. Hence, the first locking projection 6114 and the second locking projection 6124 remove from the two retaining recesses 502 of the socket 50 individually. With reference to FIG. 21, the first locking projection 6114 and the second locking projection 6124 retract into the fitting zone defined by the first fitting portion 6113 and the second fitting portion 6123, so the socket is rotated 45 degrees easily. In addition, the first fitting portion 6113 has the two first tilted faces 6115, and the second fitting portion 6123 has the two second tilted faces 6125. Thus, the socket 50 is rotated 45 degrees easily by way of the two first tilted faces 6115 and the two second tilted faces 6125, and two diagonal corners of the square hole 501 of the socket 50 are revolved to correspond to the first locking projection 6114 and the second locking projection 6124 respectively.

Figure 22:
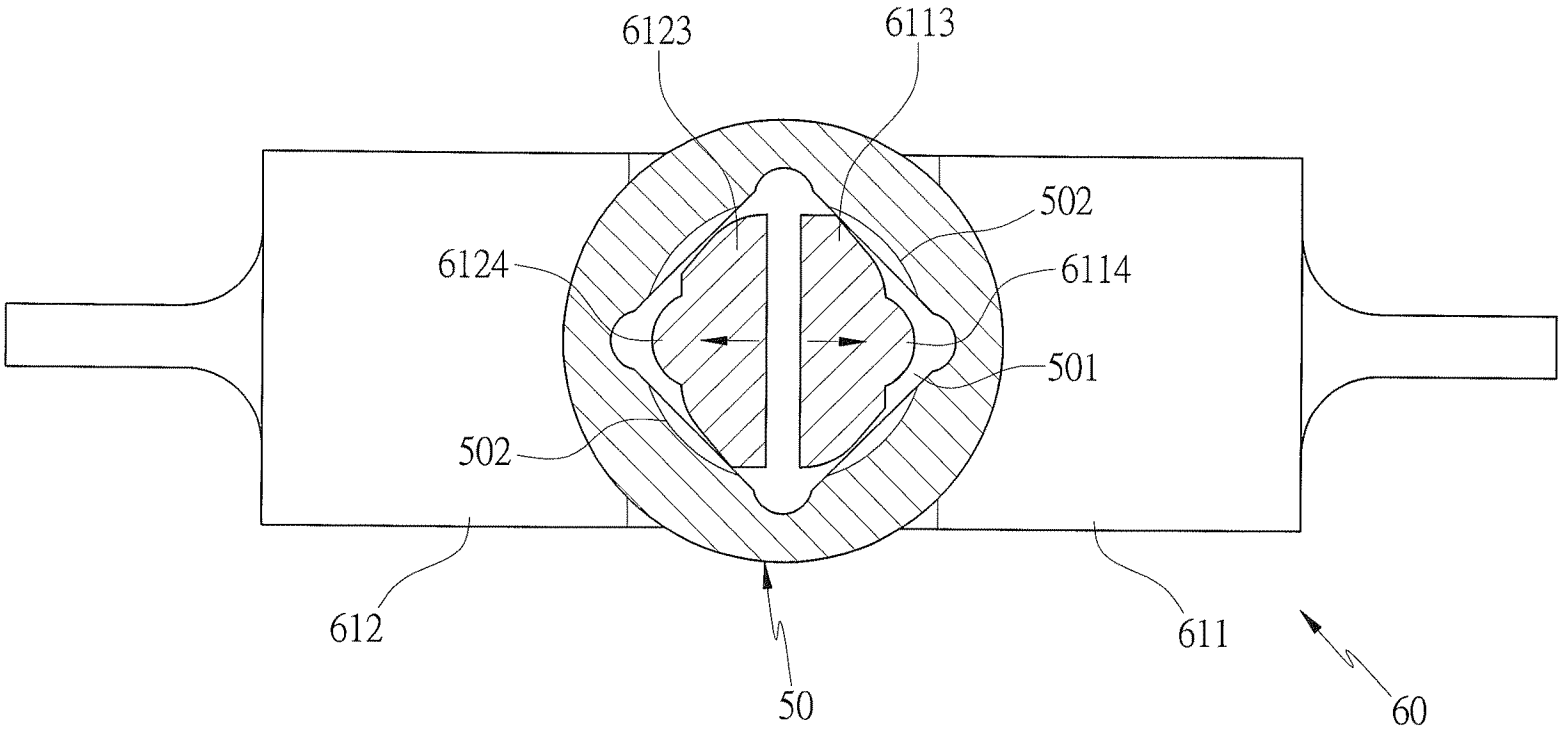

Referring to FIG. 22, when stopping pressing the socket 50, the first side plate 611 and the second side plate 612 of each body 61 return to their original positions individually, and the first fitting portion 6113, the second fitting portion 6123, the first locking projection 6114, and the second locking projection 6124 return back to their original positions respectively. Due to the first locking projection 6114 and the second locking projection 6124 corresponding to the two diagonal corners of the square hole 501 of the socket 50, and due to a distance between the two diagonal corners of the square hole 501 being more than an extending distance of each of the first locking projection 6114 and the second locking projection 6124, the first locking projection 6114 and the second locking projection 6124 do not retain with the socket 50. Hence, the socket 50 is removed easily.

Figure 23:
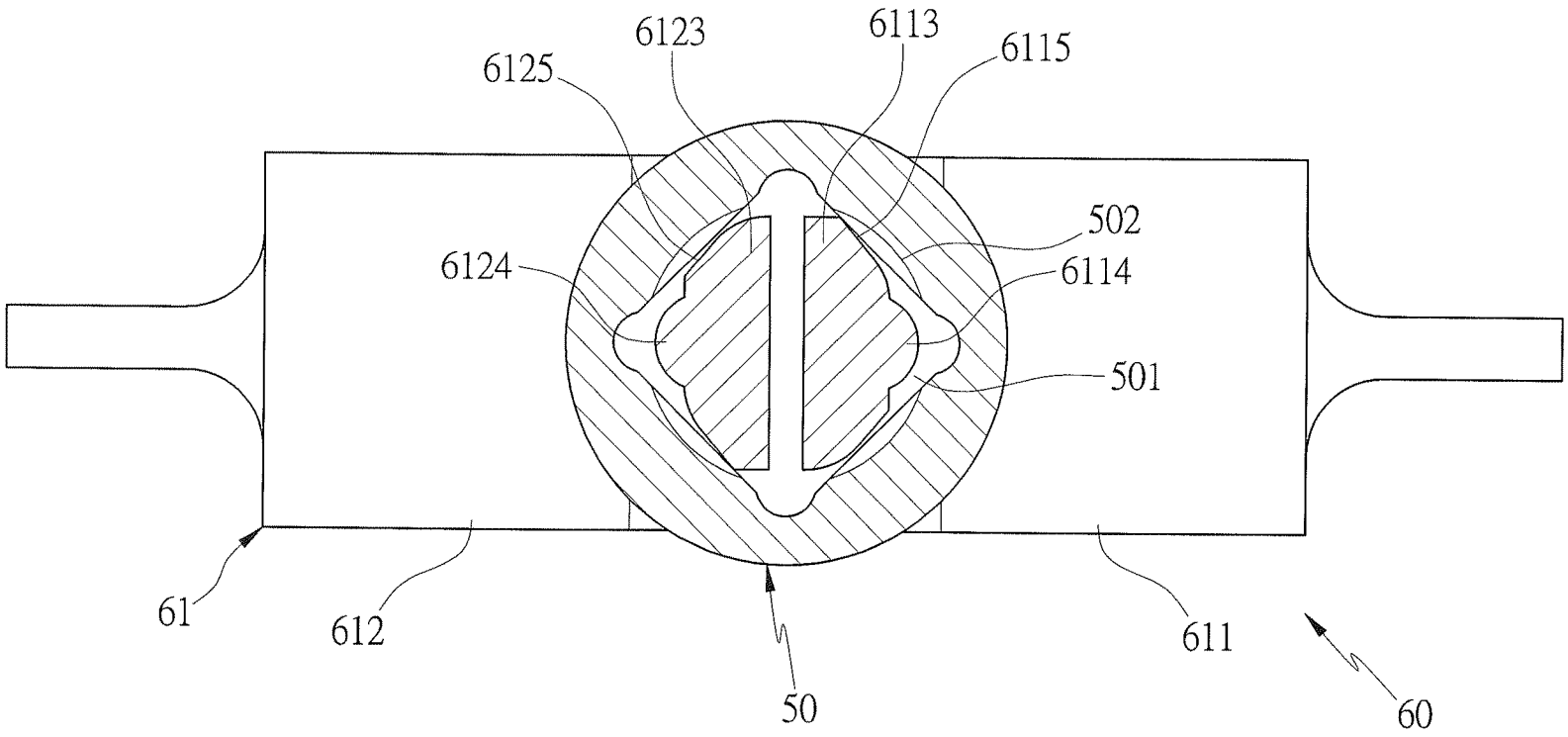
Figure 24:
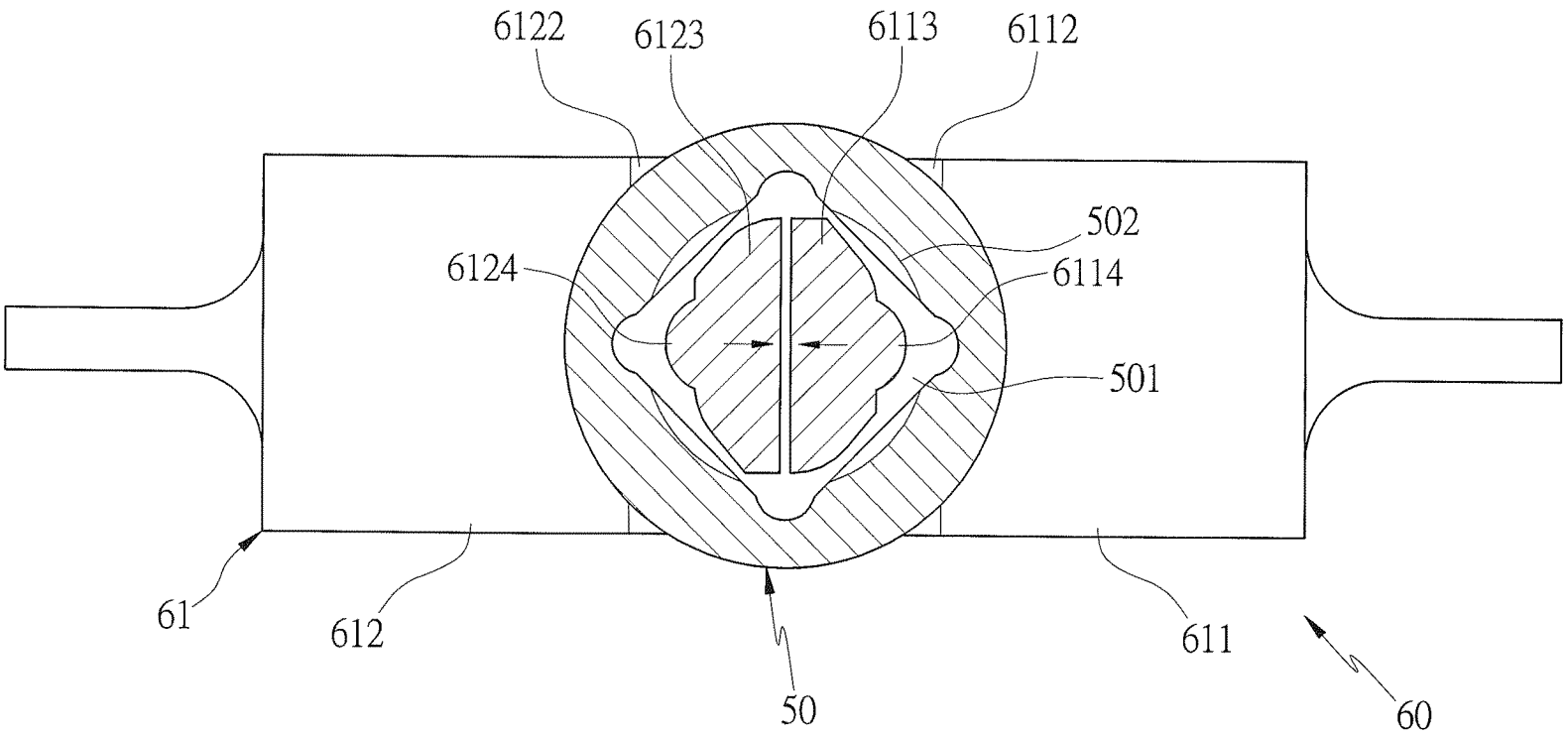
Figure 25:
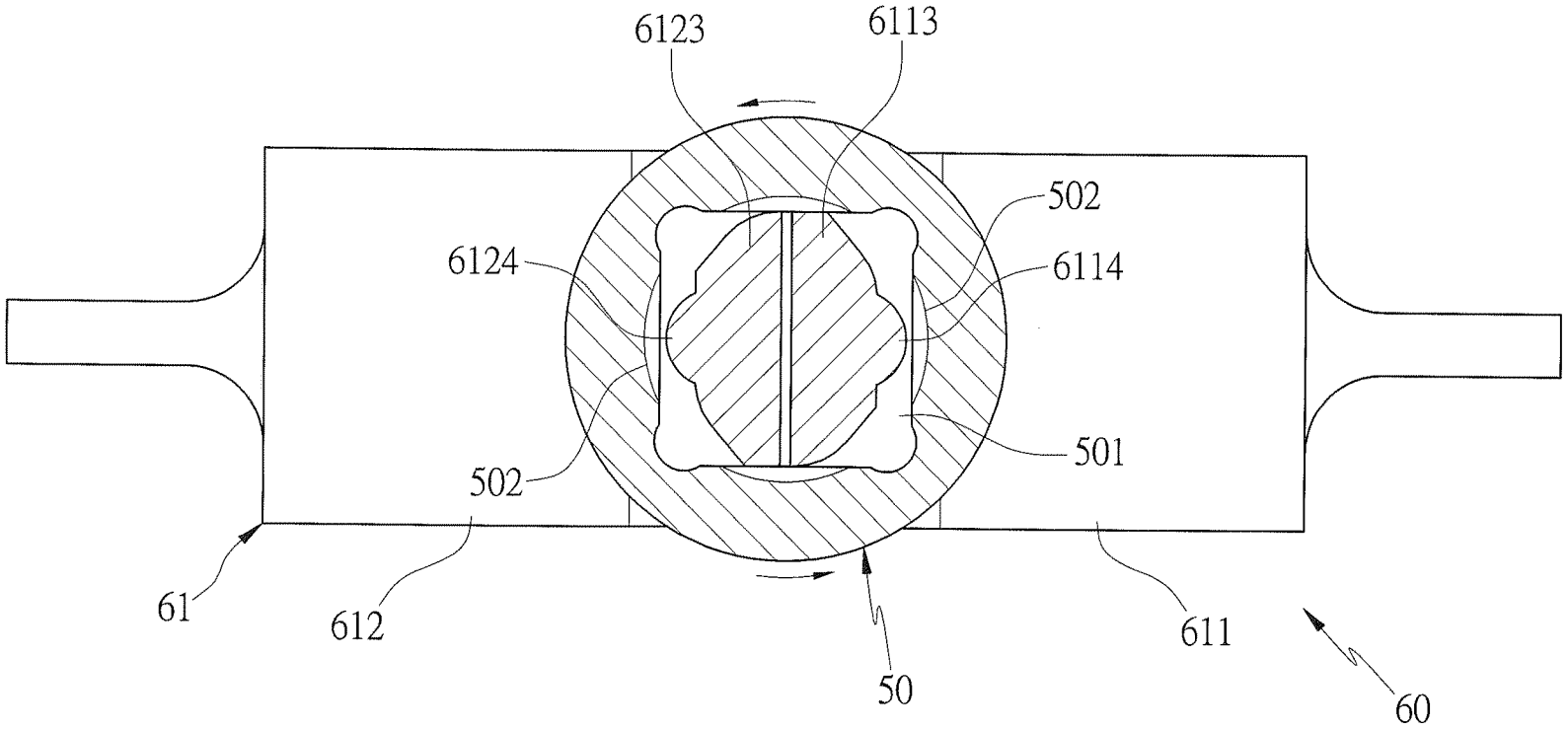
Figure 26:
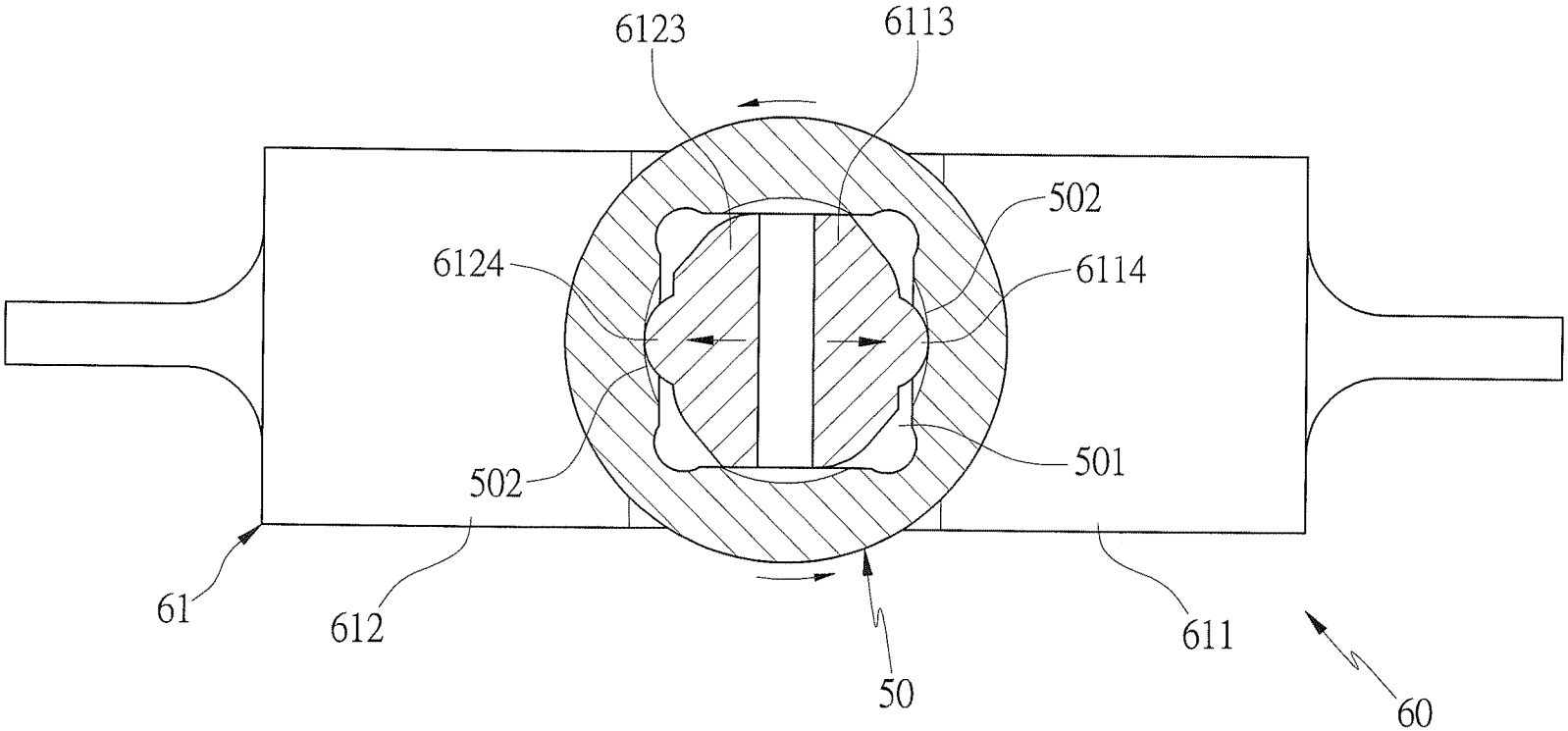

As shown in FIG. 23, after using the socket 50, it is fixed on the connector 60, so that the two diagonal corners of the square hole 501 of the socket 50 correspond to the first locking projection 6114 and the second locking projection 6124 respectively. Since the distance between the two diagonal corners of the square hole 501 is more than the extending distance of each of the first locking projection 6114 and the second locking projection 6124, the square hole 501 of the socket 50 fits with the first fitting portion 6113 and the second fitting portion 6123. As illustrated in FIG. 24, the socket 50 is pressed so that its end portion abuts against the first stop portion 6112 of the first side plate 611 and the second stop portion 6122 of the second side plate 612, and the first side plate 611 and the second side plate 612 drive the deformation of the first fitting portion 6113 and the second fitting portion 6123. Hence, the first locking projection 6114 and the second locking projection 6124 retract into the fitting zone defined by the first fitting portion 6113 and the second fitting portion 6123. With reference to FIG. 25, the socket 50 is rotated 45 degrees, so that the two retaining recesses 502 of the socket 50 correspond to the first locking projection 6114 and the second locking projection 6124 individually. Referring further to FIG. 26, when stopping pressing the socket 50, the first side plate 611 and the second side plate 612 of each body 61 return to their original positions respectively, and the first fitting portion 6113, the second fitting portion 6123, the first locking projection 6114, and the second locking projection 6124 return to their original positions individually. Hence, the first locking projection 6114 and the second locking projection 6124 individually retain with the two retaining recesses 502, thus re-fitting the socket 50 with the connector 60.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool holder comprising:

a connector including at least one body, with each of the at least one body having a first side plate and a second side plate, with the connector also including a fixing mount connecting with a first end of the first side plate and a first end of the second side plate, with the first side plate having a first fitting portion extending from a second end thereof away from the fixing mount, with the second side plate having a second fitting portion extending from a second end thereof away from the fixing mount, wherein the first fitting portion and the second fitting portion define a square fitting zone, wherein the first side plate further has a first locking projection arranged on the first fitting portion thereof and extending out of the fitting zone, wherein among the first side plate, the second side plate and the fixing mount is defined a cavity, wherein the first side plate and the second side plate drive the first fitting portion and the second fitting portion to deform in the cavity and drive the first locking projection to retract into the fitting zone, wherein a returning section extends between and connects the second ends of the first and second side plates; and a fixer housed in the cavity of the connector to limit the first side plate and the second side plate to drive the first fitting portion and the second fitting portion to deform.

2. The tool holder as claimed in claim 1, wherein the first side plate also has a first extension bending inwardly from the first end thereof, wherein the second side plate also has a second extension bending inwardly from the first end thereof, wherein the fixing mount has a first accommodation groove defined on a first side thereof to fit with the first extension, and wherein the fixing mount has a second accommodation groove defined on a second side thereof to fit with the second extension.

3. The tool holder as claimed in claim 1, wherein the first end of the first side plate and the first end of the second side plate are integrally connected with the fixing mount.

4. The tool holder as claimed in claim 1, wherein the first side plate further has a first stop portion formed on the second end thereof, and wherein the second side plate further has a second stop portion formed on the second end thereof.

5. The tool holder as claimed in claim 1, wherein the first fitting portion and the second fitting portion of the connector define the fitting zone which is square to fit a tool.

6. The tool holder as claimed in claim 1, wherein the second side plate has a second locking projection arranged on the second fitting portion thereof and corresponding to the first locking projection.

7. The tool holder as claimed in claim 1, wherein the first fitting portion has two first tilted faces defined on two edges of an outer rim thereof respectively, and wherein the second fitting portion has two second tilted faces defined on two edges of an outer rim thereof respectively.

8. The tool holder as claimed in claim 1, wherein the fixer includes two columns extending downwardly from two end portions thereof respectively, wherein each column has a neck formed on a first end thereof and a flexible fastening tab arranged on a second end thereof, wherein the fixing mount further has two orifices, and wherein each orifice is configured to accommodate the fastening tab of said column.

9. The tool holder as claimed in claim 1, wherein one end of the fixer integrally connects with the fixing mount, and wherein the fixer includes a neck formed on a peripheral side thereof.

* * * * *